US012460326B1

(12) United States Patent
Bruce et al.

(10) Patent No.: US 12,460,326 B1
(45) Date of Patent: Nov. 4, 2025

(54) ONE-PIECE KNITTED ARTICLE FOR LOWER PORTION OF HUMAN BODY AND METHODS FOR KNITTING SAME

(71) Applicant: Global Apparel Partners Inc., Malibu, CA (US)

(72) Inventors: Mark Bruce, Woodland Hills, CA (US); William Samosir, Brooklyn, NY (US); Garrett Li Gerson, Malibu, CA (US)

(73) Assignee: Global Apparel Partners Inc., Malibu, CA (US)

( * ) Notice: Subject to any disclaimer, the term of this patent is extended or adjusted under 35 U.S.C. 154(b) by 0 days.

(21) Appl. No.: 19/075,590

(22) Filed: Mar. 10, 2025

(51) Int. Cl.
*D04B 1/24* (2006.01)
*D04B 15/66* (2006.01)

(52) U.S. Cl.
CPC ..... *D04B 1/24* (2013.01); *D04B 15/66* (2013.01); *D10B 2501/02* (2013.01); *D10B 2501/063* (2013.01)

(58) Field of Classification Search
CPC . D04B 1/24; D04B 1/243; D04B 1/26; D04B 1/265; D04B 7/10; D04B 7/30; D04B 7/32
See application file for complete search history.

(56) References Cited

U.S. PATENT DOCUMENTS 3,673,821 A * 7/1972 Johnson ..... D04B 1/243 2/409
3,802,229 A * 4/1974 Fregeolle ..... D04B 1/243 66/177
5,377,507 A * 1/1995 Shima ..... D04B 1/243 66/172 R
7,212,881 B2 * 5/2007 Kazuyoshi ..... D04B 1/246 66/64
7,529,596 B2 * 5/2009 Okamoto ..... D04B 1/243 66/64
7,536,878 B2 * 5/2009 Kosui ..... D04B 1/22 66/64
7,577,488 B2 * 8/2009 Okamoto ..... D04B 1/243 66/64
(Continued)

OTHER PUBLICATIONS

Baker, Elaine, "Ladyfingers—AG doll—Panties with Tutorial", Knitting & Crocheting Forums, Aug. 2012, retrieved from: https://www.knittingparadise.com/threads/ladyfingers-ag-doll-panties-with-tutorial. 122696/#replies, 12 pgs.
(Continued)

*Primary Examiner* — Danny Worrell
(74) *Attorney, Agent, or Firm* — Ascenda Law Group, PC

(57) ABSTRACT

A method for generating a knitted article having a first, second and third opening, the knitted article adapted to cover at least a groin, a first thigh portion and a second thigh portion of a human body. The method includes using flatbed knitting machine to knit a first portion of the knitted article for covering the first thigh portion, then to knit a second portion of the knitted article for covering the groin and then to knit a third portion of the knitted article for covering the second thigh portion. The first, second and third portions of the knitted article form a one-piece, non-planar knitted article. A pair of edges of the knitted article are affixed to form a first seam, and another pair of edges are affixed to form a second seam facing away from the first seam.

23 Claims, 27 Drawing Sheets

(56) References Cited

U.S. PATENT DOCUMENTS

| | | | | |
|---|---|---|---|---|
| 7,693,599 | B2 * | 4/2010 | Okamoto | D04B 1/246 66/175 |
| 7,997,102 | B2 * | 8/2011 | Obadalova | D04B 1/108 66/177 |
| 8,434,331 | B2 * | 5/2013 | Funaki | D04B 1/108 66/65 |
| 10,415,164 | B2 * | 9/2019 | Diaz | D04B 1/108 |
| 11,877,605 | B2 * | 1/2024 | Montgomery | D04B 1/108 |
| 2003/0106344 | A1 * | 6/2003 | Okamoto | D04B 1/246 66/64 |
| 2004/0065123 | A1 * | 4/2004 | Okamoto | D04B 1/24 66/49 |
| 2017/0073860 | A1 * | 3/2017 | Rockstroh | D04B 1/18 |
| 2023/0357968 | A1 | 11/2023 | Samosir et al. | |

OTHER PUBLICATIONS

Meinhilde, "Free Adult Pant and Legging Knitting Patterns", Kiku Corner, Nov. 22, 2021, retrived from: https://www.kikucorner.com/2021/11/22/free-adult-pant-legging-knitting-patterns/, 12 pgs.

* cited by examiner

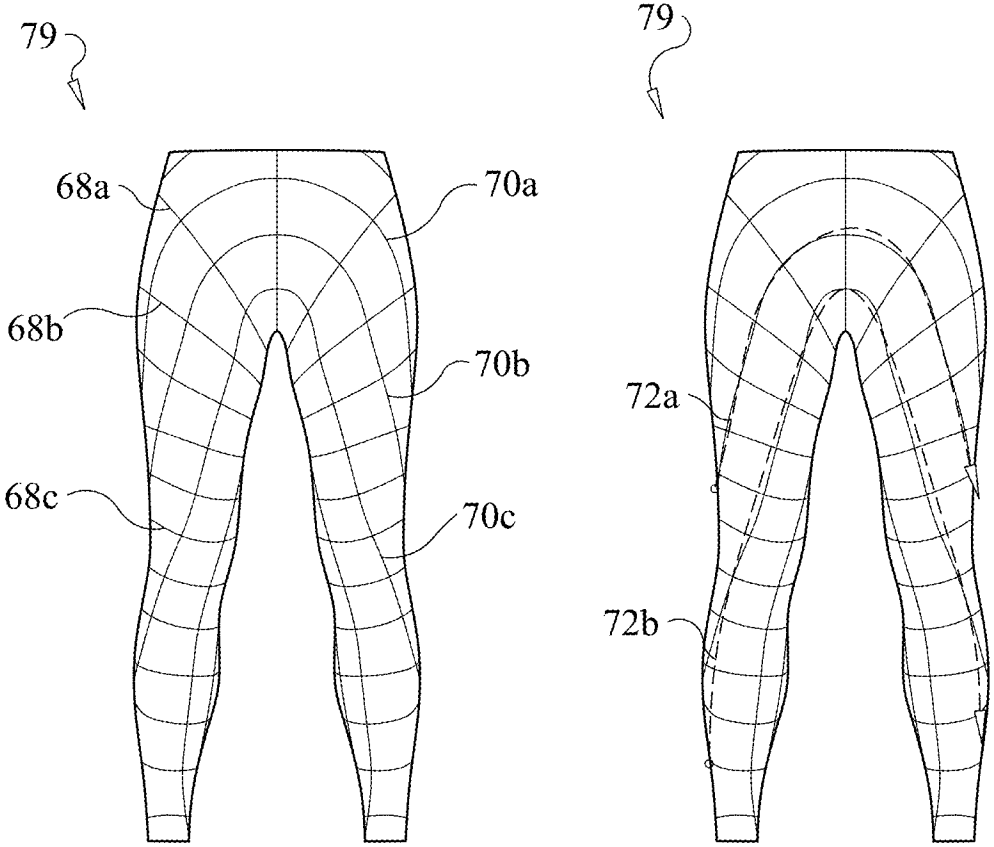
FIG. 13A
FIG. 13B
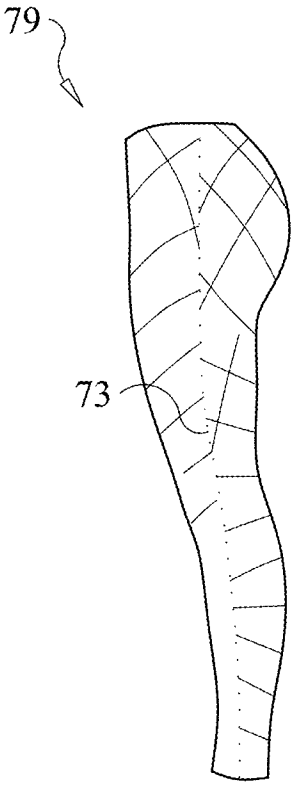
FIG. 13C

ONE-PIECE KNITTED ARTICLE FOR LOWER PORTION OF HUMAN BODY AND METHODS FOR KNITTING SAME

FIELD OF THE INVENTION

The present invention relates to a one-piece knitted article for the lower portion of the human body and methods for knitting same, and more particularly relates to a one-piece knitted article with two seams each running from the top to the bottom of the knitted article, and with the two seams facing away from one another.

BACKGROUND

There exists various ways to knit articles of clothing for the lower portion of the human body. Such articles of clothing generally include one opening that wraps around the torso of the human body, and two openings that each wraps around one leg of the human body. With existing cut-and-sew constructions, knitted articles may be developed in multiple pieces, introducing throw-away pieces, which is time consuming and wasteful. In some existing constructions, a seam is present at the gusset area (e.g., from front rise to back rise), which may cause discomfort to the wearer (e.g., skin irritation) and performance problems (e.g., restricted or uneven stretching of fabric). In some constructions, such articles of clothing can be produced completely seamless using a tubular technique on a flatbed machine, but such constructions limit the structural construction to single jersey or purl—which precludes the possibility of structures such as ribs, which are vital for performance, waist fit, opacity, etc.

Described herein are techniques to produce knitted articles for the lower portion of the human body that improve upon the current techniques.

SUMMARY OF THE INVENTION

In accordance with one embodiment of the invention, a method is described for generating a knitted article having a first, second and third opening, the knitted article adapted to cover at least a groin, a first thigh portion and a second thigh portion of a human body. The method includes using a flatbed knitting machine to knit a first portion of the knitted article for covering the first thigh portion, then knit a second portion of the knitted article for covering the groin and then knit a third portion of the knitted article for covering the second thigh portion. The first, second and third portions of the knitted article may form a one-piece knitted article. The knitted article may also be non-planar with shaping provided by goring regions of the two-dimensional (2D) knitting map used to produce knitting instructions for controlling a flatbed knitting machine.

In accordance with one embodiment of the invention, the knitted article comprises first, second, third, fourth, fifth, sixth, seventh and eighth edges, the first edge connected to the second edge, the second edge connected to the third edge, the third edge connected to the fourth edge, the fourth edge connected to the fifth edge, the fifth edge connected to the sixth edge, the sixth edge connected to the seventh edge, the seventh edge connected to the eighth edge, and the eighth edge connected to the first edge. The second edge may be affixed to the eighth edge, and the fourth edge may be affixed to the sixth edge. The first edge may form the first opening of the knitted article, the third and seventh edges may form the second opening of the knitted article, and the fifth edge may form the third opening of the knitted article.

In accordance with one embodiment of the invention, the knitted article is knit starting from the portion for covering at least a portion of one leg of the human body, followed by the portion for covering the groin of the human body, and followed by another portion for covering at least a portion of the other leg of the human body.

In accordance with one embodiment of the invention, the knitting method provides the ability to control multiple structures and/or yarn combinations without restrictions to knit type.

In accordance with one embodiment of the invention, knitted article may include two seams, each running from the top of the knitted article to the bottom of the knitted article and facing away from one another.

In accordance with one embodiment of the invention, the knitting method allows for inlays around the portion of the knitted article covering the leg and from the front hem to back hem.

In accordance with one embodiment of the invention, the knitting method permits the incorporation of multiple compression properties in the knitted article.

In accordance with one embodiment of the invention, the knitting method permits the waistband to be knit using a two-bed construction.

In accordance with one embodiment of the invention, the knitting method permits the addition of surface area to accommodate a shape of the human body.

In accordance with one embodiment of the invention, the gusset area of the knitted article is seamless for improved comfort for the wearer.

In accordance with one embodiment of the invention, the knitted article does not include a front rise seam or a back rise seam.

In accordance with one embodiment of the invention, the knitted article permits the incorporation of multiple structures and/or components (e.g., pockets, slits, etc.) and surface area in parts with no seams.

In accordance with one embodiment of the invention, the knitted article may be knit using a smaller and/or tighter machine. For example, the knitted article may be knit using STOLL ADF®/530 (with 699 needles) instead of a STOLL 830® (with 1175 needles), both the STOLL ADF and STOLL 830 manufactured by STOLL® of Reutlingen, Germany.

These and other embodiments of the invention are described in more detail in the description below.

BRIEF DESCRIPTION OF THE DRAWINGS

The present invention is illustrated by way of example, and not limitation, in the figures of the accompanying drawings, in which:

FIG. 13A depicts a front view of a model of the knitted article, with lines indicating the orientation of courses and wales, in accordance with one embodiment of the invention.

FIG. 13B depicts a knitting direction indicated on the model of the knitted article, in accordance with one embodiment of the invention.

FIG. 13C depicts a seam indicated on a side view of the model of the knitted article, in accordance with one embodiment of the invention.

DETAILED DESCRIPTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. Descriptions associated with any one of the figures may be applied to different figures containing like or similar components/steps. While the sequence diagrams each present a series of steps in a certain order, the order of some of the steps may be changed without departing from the scope of the present invention.

Figure 1:
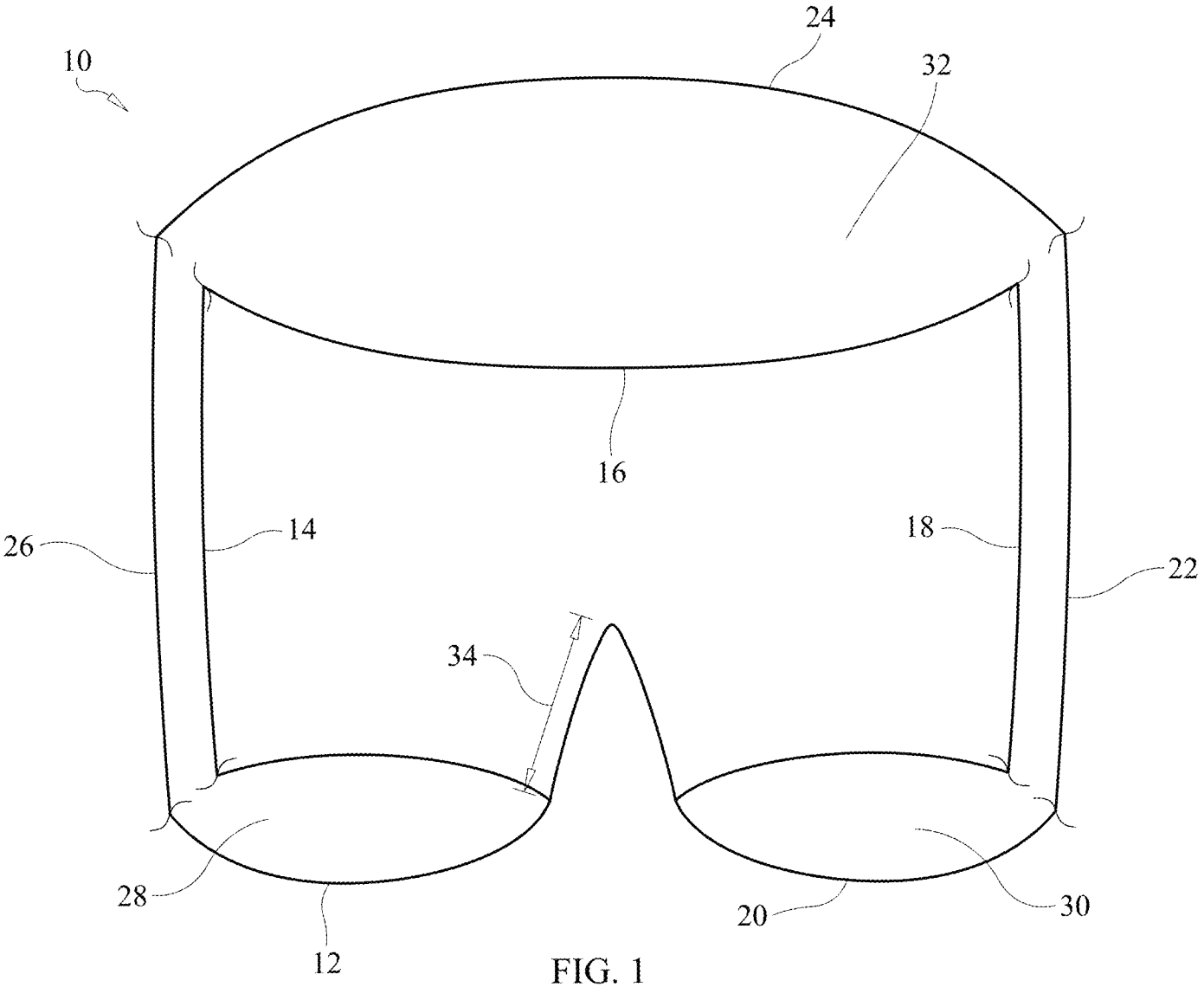
FIG. 1 depicts a knitted article in the form of shorts, boxer shorts or swim wear, in accordance with one embodiment of the invention.

FIG. 1 depicts a knitted article 10 in the form of shorts, boxer shorts, medical shorts or swim wear (e.g., jammers or swim trunks). It should be understood that FIG. 1 more precisely depicts a schematic of knitted article 10. Knitted article 10 may include edges 12, 14, 16, 18, 20, 24 and 26. Edge 12 may be connected to edge 14. Edge 14 may be connected to edge 16. Edge 16 may be connected to edge 18. Edge 18 may be connected to edge 20. Edge 20 may be connected to edge 22. Edge 22 may be connected to edge 24. Edge 24 may be connected to edge 26. Finally, edge 26 may be connected to edge 12. Each of the pair of edges 12 and 14, the pair of edges 14 and 16, the pair of edges 16 and 18, the pair of edges 18 and 20, the pair of edges 20 and 22, the pair of edges 22 and 24, the pair of edges 24 and 26, and the pair of edges 26 and 12 may form an angle approximately in a range between 80°-100°, and preferably around 90°.

Figure 7:
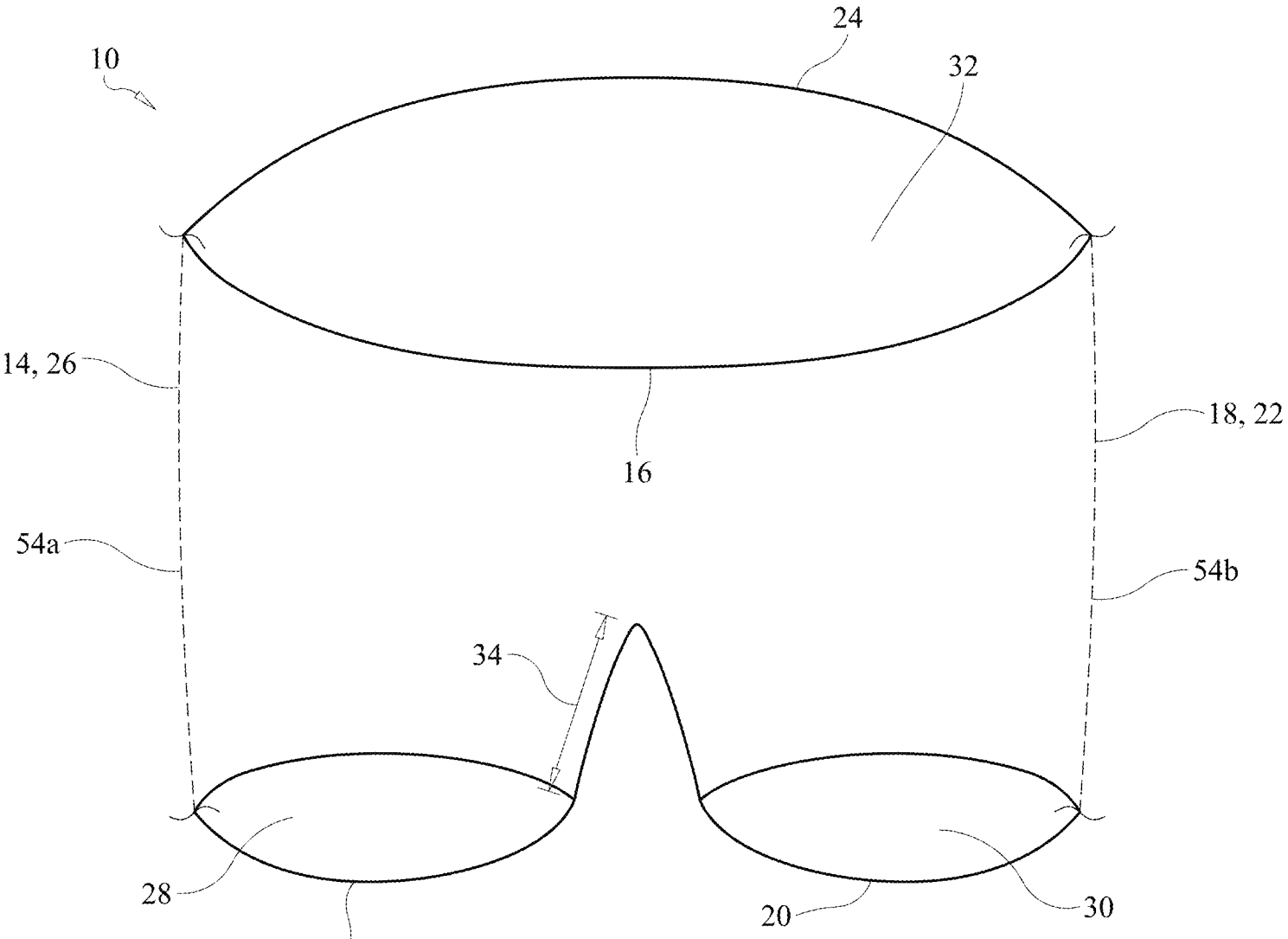
FIG. 7 depicts seams of the knitted article of FIG. 1, in accordance with one embodiment of the invention.

Edge 14 may be affixed to edge 26 via one or more affixing means, and edge 18 may be affixed to edge 22 via one or more affixing means. The one or more affixing means may include thread (e.g., by sewing), a zipper, a hook and loop fastener (e.g., VELCRO® fastener), linking, and welding (e.g., ultrasonic welding). As depicted in FIG. 7, affixing edge 14 to edge 26 may form seam 54*a* and affixing edge 18 to edge 22 may form seam 54*b* that faces away from seam 54*a*. Seam 54*a* may geometrically connect a point on edge 12 with a point on edge 16. Similarly, seam 54*b* may geometrically connect a point on edge 20 with a point on edge 16. To emphasize, seams 54*a* and 54*b* may be the only seams that are present in knitted article 10.

Figure 6:
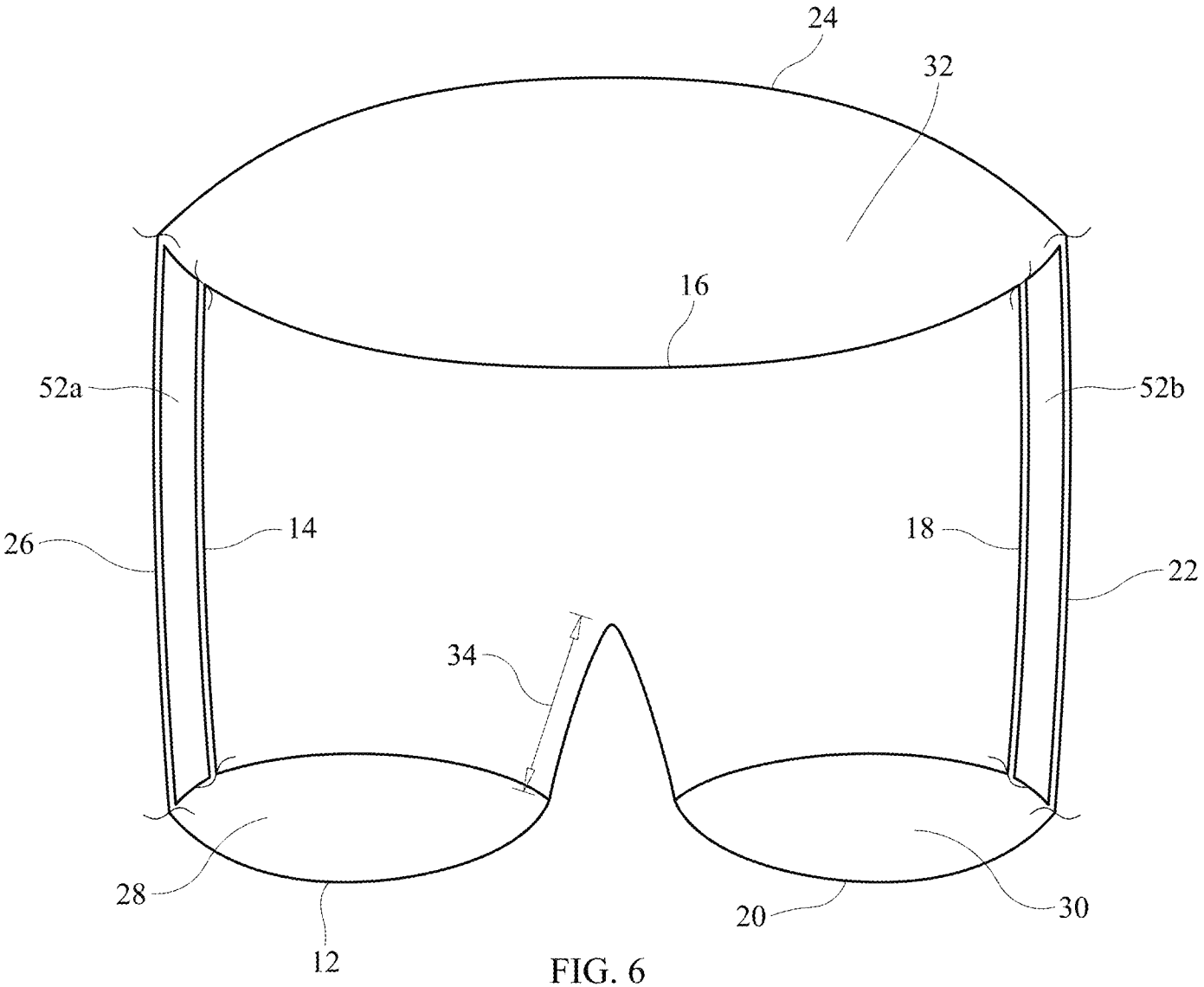
FIG. 6 depicts strips of material for affixing respective edges of the knitted article of FIG. 1, in accordance with one embodiment of the invention.

In another embodiment, as depicted in FIG. 6, edges 14 and 26 may each be attached to a strip of material 52*a* with a material distinct from the knitted article 10. Similarly, edges 18 and 22 may each be attached to a strip of material 52*b* with a material distinct from the knitted article 10. For example, the elasticity of the strips of material 52*a*, 52*b* may be different from the elasticity of the knitted article 10.

After the above-described affixing operation, edge 12 may form opening 28, edge 20 may form opening 30 and edges 16 and 24 may form opening 32. As should be understood, a torso or abdomen of a human body may protrude from opening 32, and the legs of the human body may protrude from openings 28 and 30.

The location of inseam 34 is denoted in the knitted article 10 of FIG. 1. In one embodiment, inseam 34 may be a non-zero value. In contrast, inseam 34 of underwear briefs (not depicted) may be a zero value.

Figure 2:
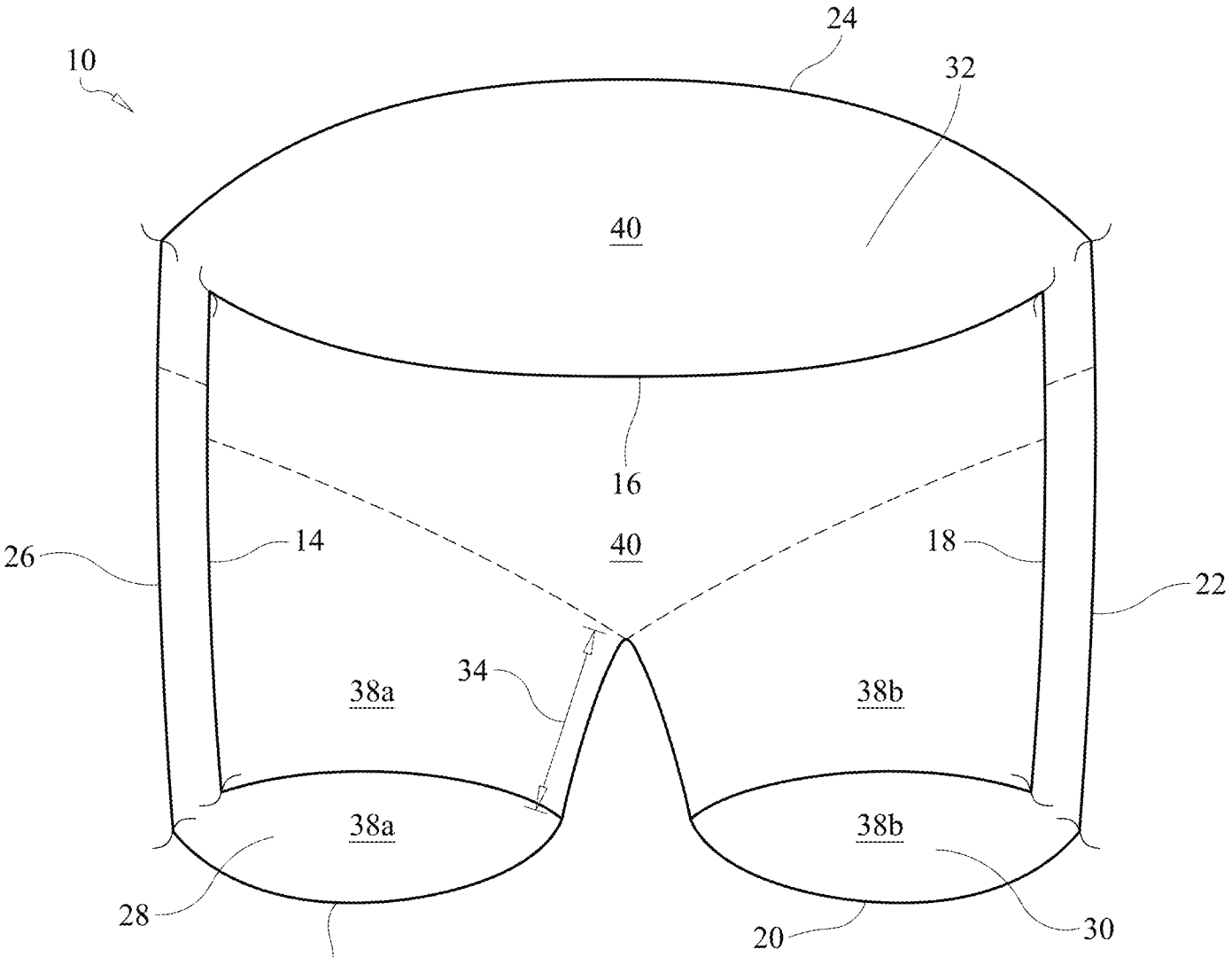
FIG. 2 annotates three portions of the knitted article of FIG. 1, in accordance with one embodiment of the invention.

FIG. 2 annotates three portions of the knitted article 10 of FIG. 1. Portions 38*a* and 38*b* may cover respective thigh portions of a human body. Portion 40 may cover a groin of the human body. Together, portions 38*a*, 38*b* and 40 of the knitted article may form a one-piece, non-planar knitted article. By "one-piece," it is meant that the knitted article 10 is knitted by the flatbed knitting machine as a single piece, in contrast to some other manufacturing methods in which the flatbed knitting machine may knit a plurality of pieces that are then sewn (or otherwise attached) together to make a final article of clothing.

Figure 3:
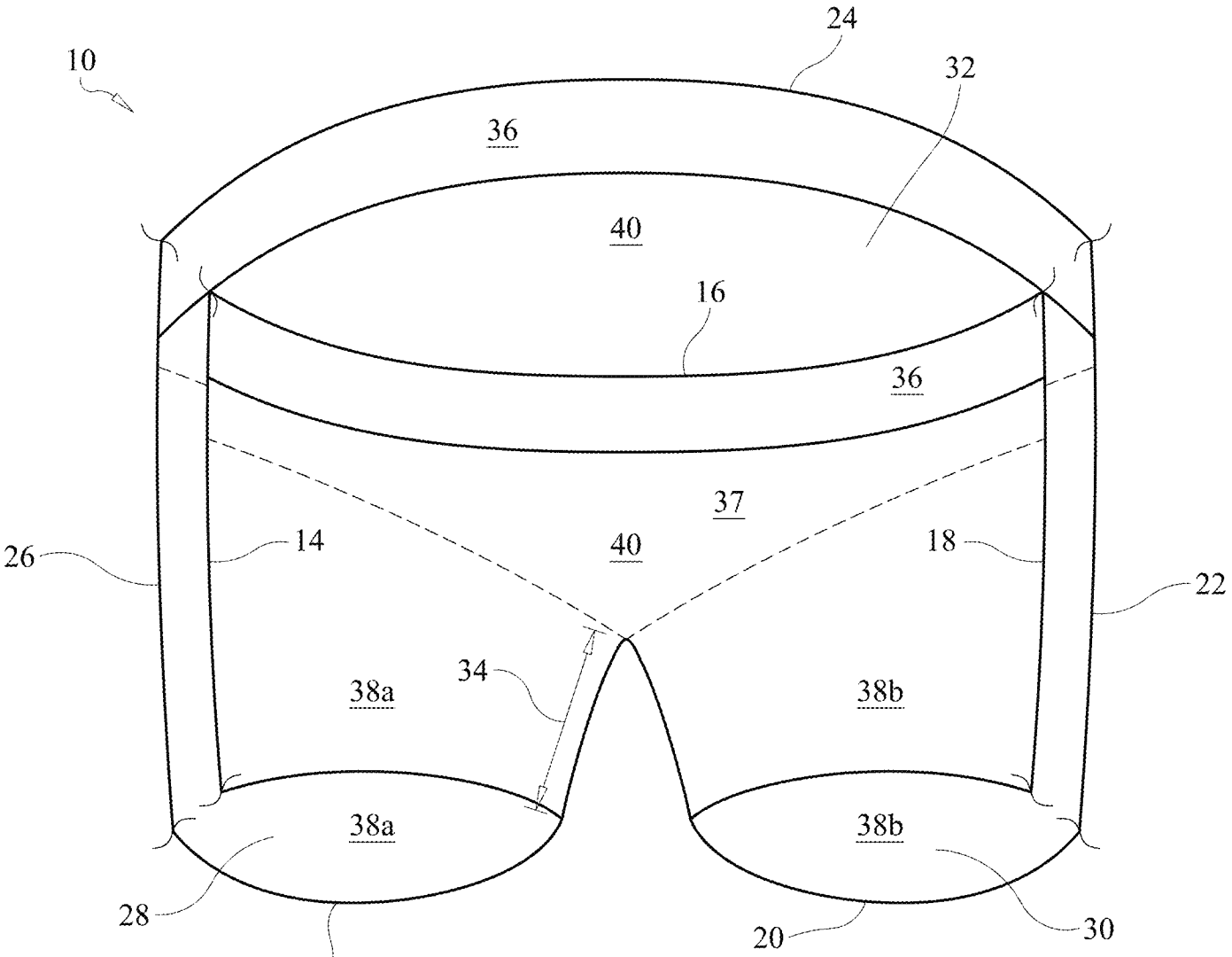
FIG. 3 depicts a waistband portion of the knitted article of FIG. 1, in accordance with one embodiment of the invention.

FIG. 3 depicts an optional waistband portion 36 of the knitted article 10 of FIG. 1. More specifically, portion 40 of the knitted article 10 may include waistband portion 36 with a first material property, and a non-waistband portion 37 with a second material property different than the first material property.

Figure 4:
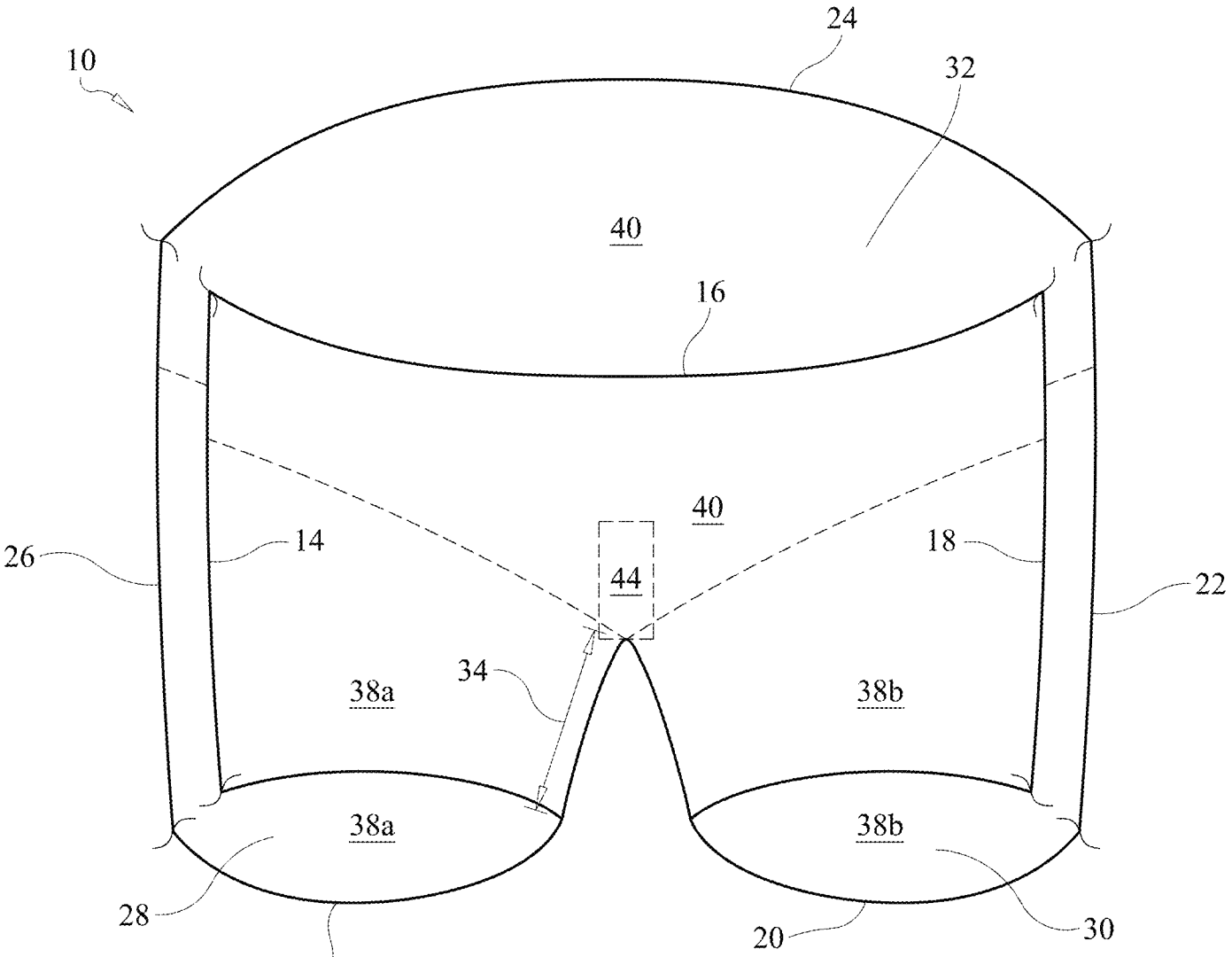
FIG. 4 depicts a gusset of the knitted article of FIG. 1, in accordance with one embodiment of the invention.
Figure 5:
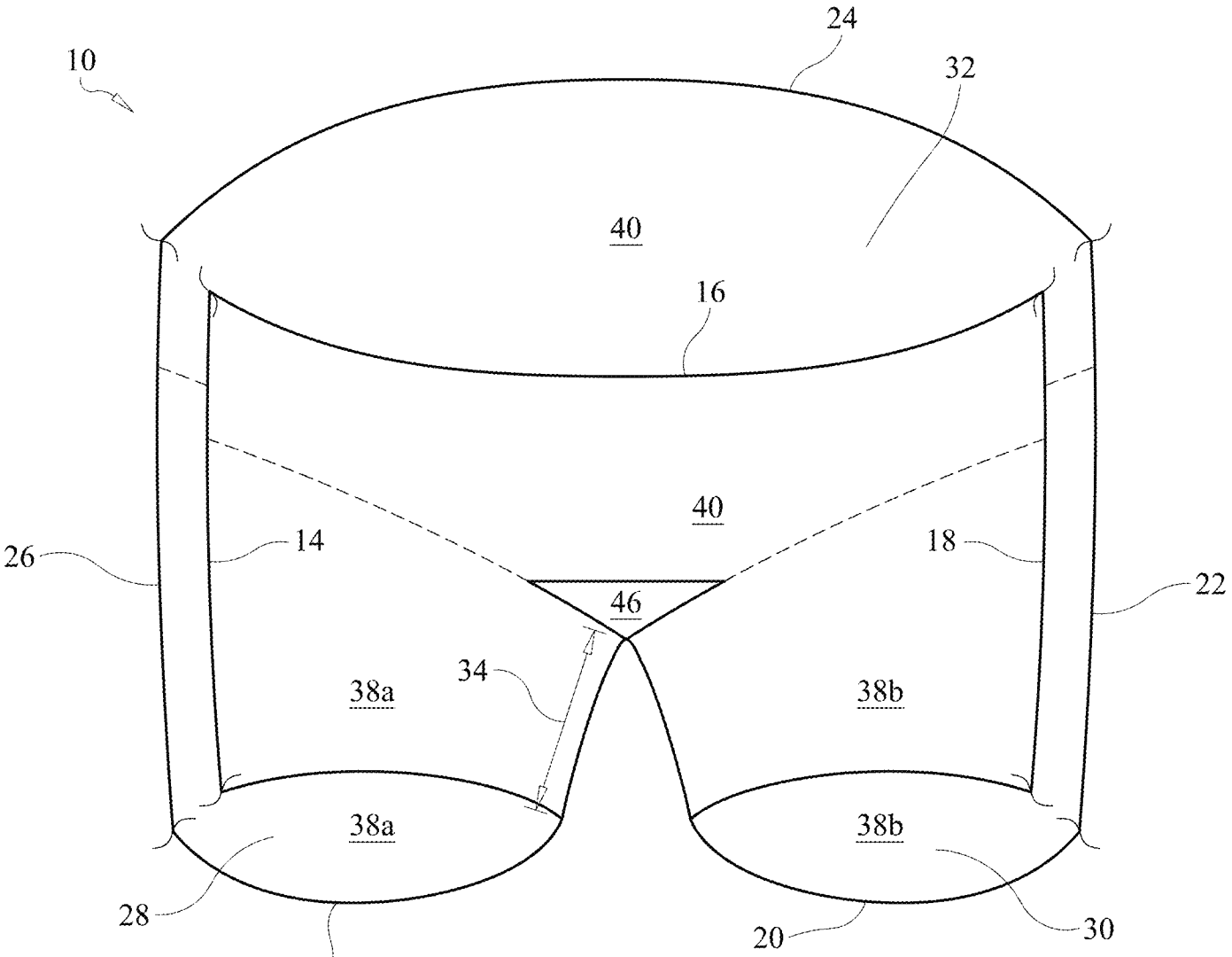
FIG. 5 depicts a pocket or spacer fabric of the knitted article of FIG. 1, in accordance with one embodiment of the invention.

FIG. 4 depicts an optional gusset 44 of the knitted article 10 of FIG. 1. More specifically, portion 40 of the knitted article 10 may include gusset 44. In one embodiment, gusset 44 is formed from a material that is more opaque than other portions of the knitted article 10. In one embodiment, gusset 44 may include one or more of a pocket or spacer fabric 46, as depicted in FIG. 5.

In one embodiment, the knitted article forms shapewear. As is known in the art, shapewear is an undergarment that is designed to control and shape portions of a human body. In one embodiment, the knitted article compresses one or more parts of the human body. In a medical setting, the knitted article with compression properties may be regarded as a medical compression wearable article.

Figure 8:
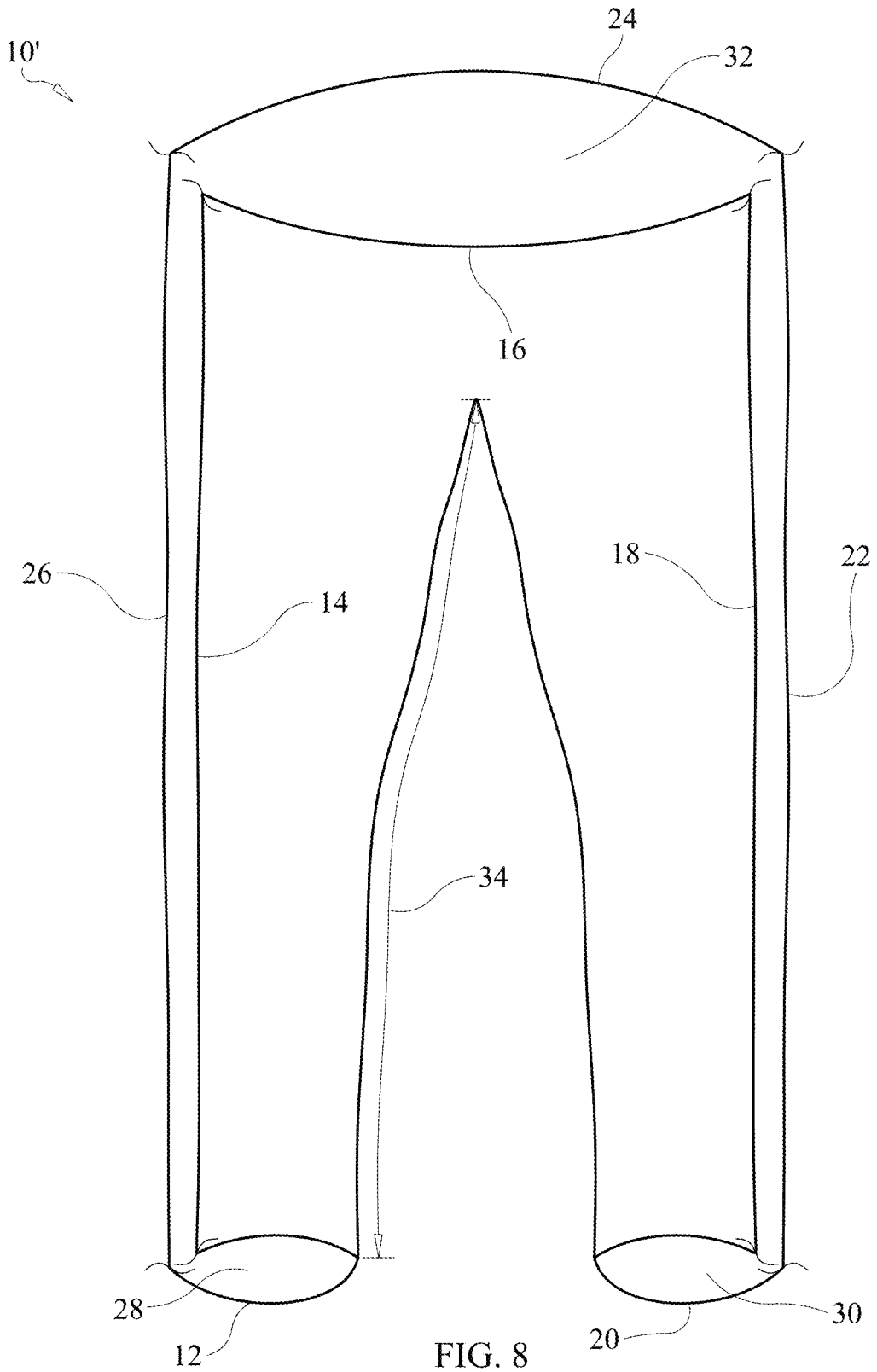
FIG. 8 depicts a knitted article in the form of leggings, pants or swimwear, in accordance with one embodiment of the invention.

FIG. 8 depicts a knitted article 10' in the form of leggings, pants, pajamas or swimwear. Some or all of the description provided above regarding knitted article 10 may apply to knitted article 10', and will not be repeated for the sake of conciseness.

Figure 9A:
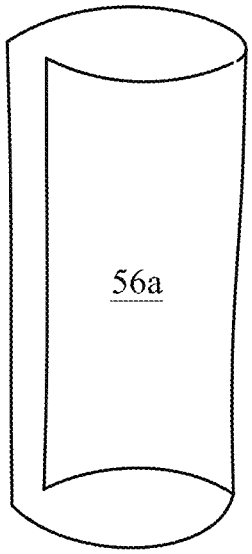
FIGS. 9A-9H depict a time series of various time points for knitting the knitted article of FIG. 8, in accordance with one embodiment of the invention.

FIGS. 9A-9H depict a time series of various time points during the knitting of the knitted article 10' of FIG. 8. First, as depicted in FIG. 9A, portion 56*a* of the knitted article 10' may be knit by a flatbed knitting machine. Portion 56*a* may be roughly rectangular in shape, although it is shown in a curled manner in FIG. 9A. Portion 56*a* may be adapted to cover a calf a human body.

Figure 9B:
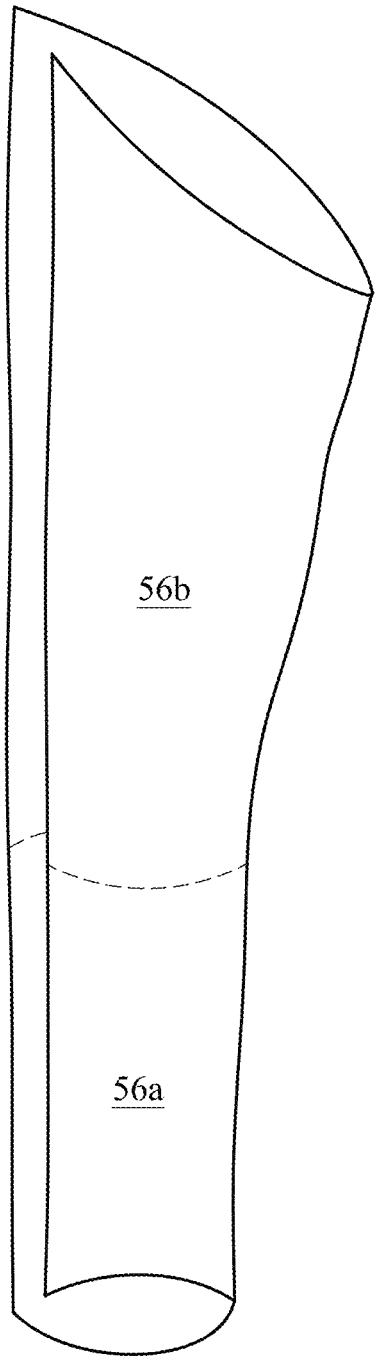

Next, as depicted in FIG. 9B, portion 56*b* of the knitted article 10' may be knit by a flatbed knitting machine. Portion 56*b* may be connected to portion 56*a* without any seam (i.e., the dashed line does not correspond to any physical structure and is being shown for clarity to indicate the various portions of knitted article 10' that are knit over time). Portion 56*b* may be adapted to cover a knee and thigh of a human body.

Figure 9C:
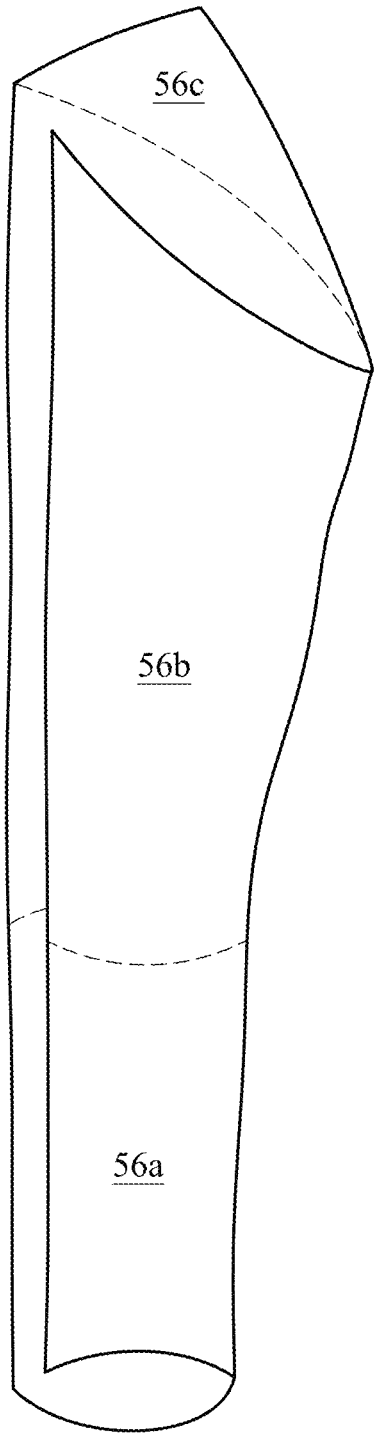

Next, as depicted in FIG. 9C, a wedge-shaped portion 56*c* of the knitted article 10' may be knit by a flatbed knitting machine. Wedge-shaped portion 56*c* may be attached to portion 56*b*. If the view of FIG. 9C were regarded as a "front view," then wedge-shaped portion 56*c* may appear on the backside of the knitted article 10.'

Figure 9D:
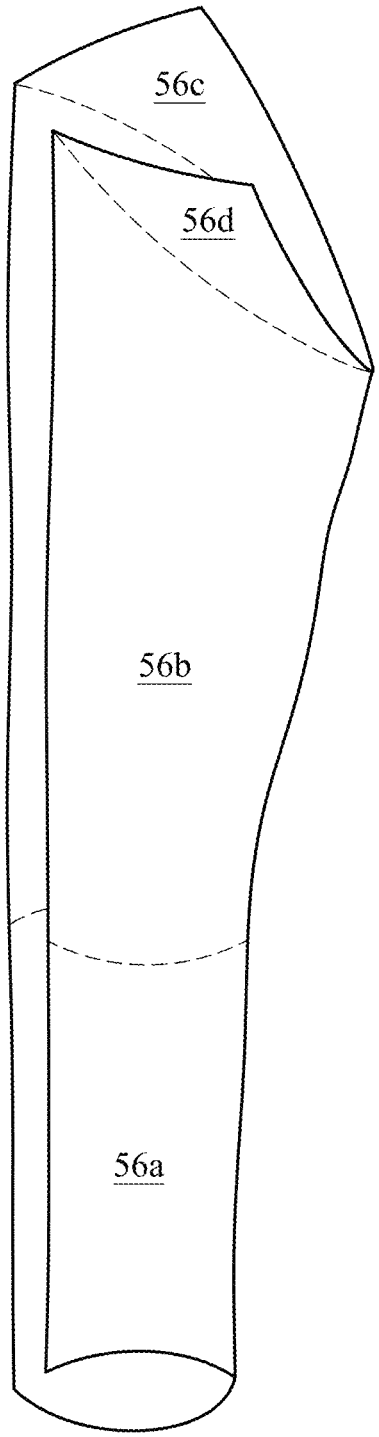

Next, as depicted in FIG. 9D, a wedge-shaped portion 56*d* of the knitted article 10' may be knit by a flatbed knitting machine. Wedge-shaped portion 56*d* may also be attached to portion 56*b*. If the view of FIG. 9D were regarded as a "front view," then wedge-shaped portion 56*d* may appear on the frontside of the knitted article 10.' As should be understood, the sequence of knitting wedge-shaped portion 56*c* before wedge-shaped portion 56*d* was for example only. In another embodiment (not depicted), wedge-shaped portion 56*d* may be knit before wedge-shaped portion 56*c*.

Figure 9E:
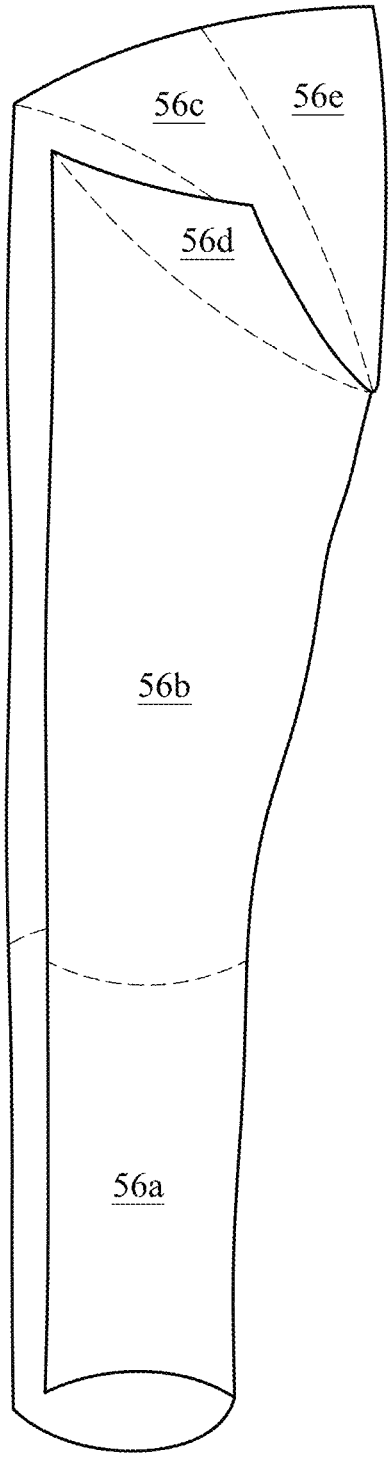

Next, as depicted in FIG. 9E, a wedge-shaped portion 56*e* of the knitted article 10' may be knit by a flatbed knitting machine. Wedge-shaped portion 56*e* may be attached to portion 56*c*. If the view of FIG. 9E were regarded as a "front view," then wedge-shaped portion 56*e* may appear on the backside of the knitted article 10.'

Figure 9F:
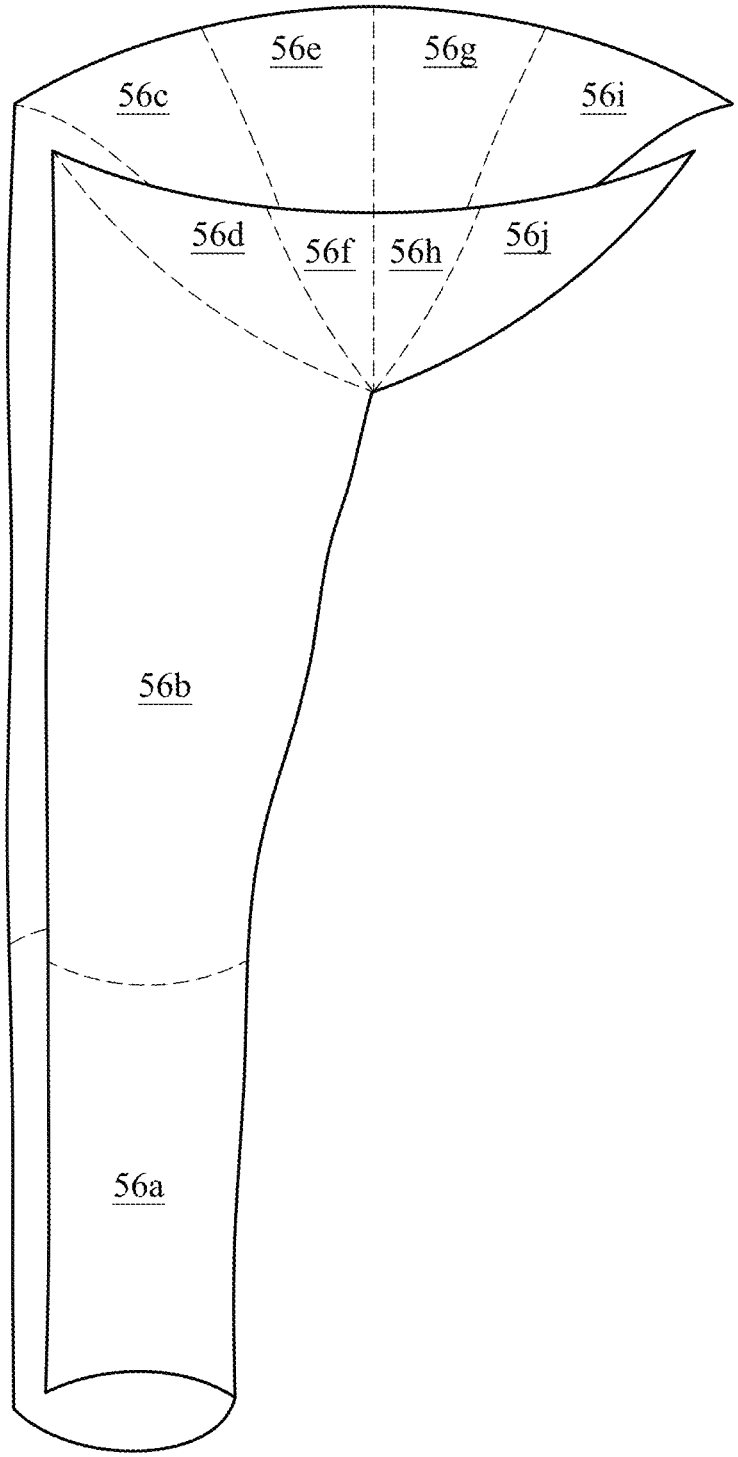

FIG. 9F fast forwards a few time points for the sake of conciseness. As should be understood, the wedge-shaped portions may be knit by alternating from a back portion to a front portion and another back portion to another front portion, and so on. In one embodiment, wedge-shaped portions may be knit in the sequence of 56*c*, then 56*d*, then 56*e*, then 56*f*, then 56*g*, then 56*h*, then 56*i* and then 56*j*. In another embodiment (not depicted), wedge-shaped portions may be knit in the sequence of 56*d*, then 56*c*, then 56*f*, then 56*e*, then 56*h*, then 56*g*, then 56*j* and then 56*i*. It is noted in other embodiments (not depicted), the number of wedge-shaped portions may be varied from the number depicted in FIG. 9F.

Figure 9G:
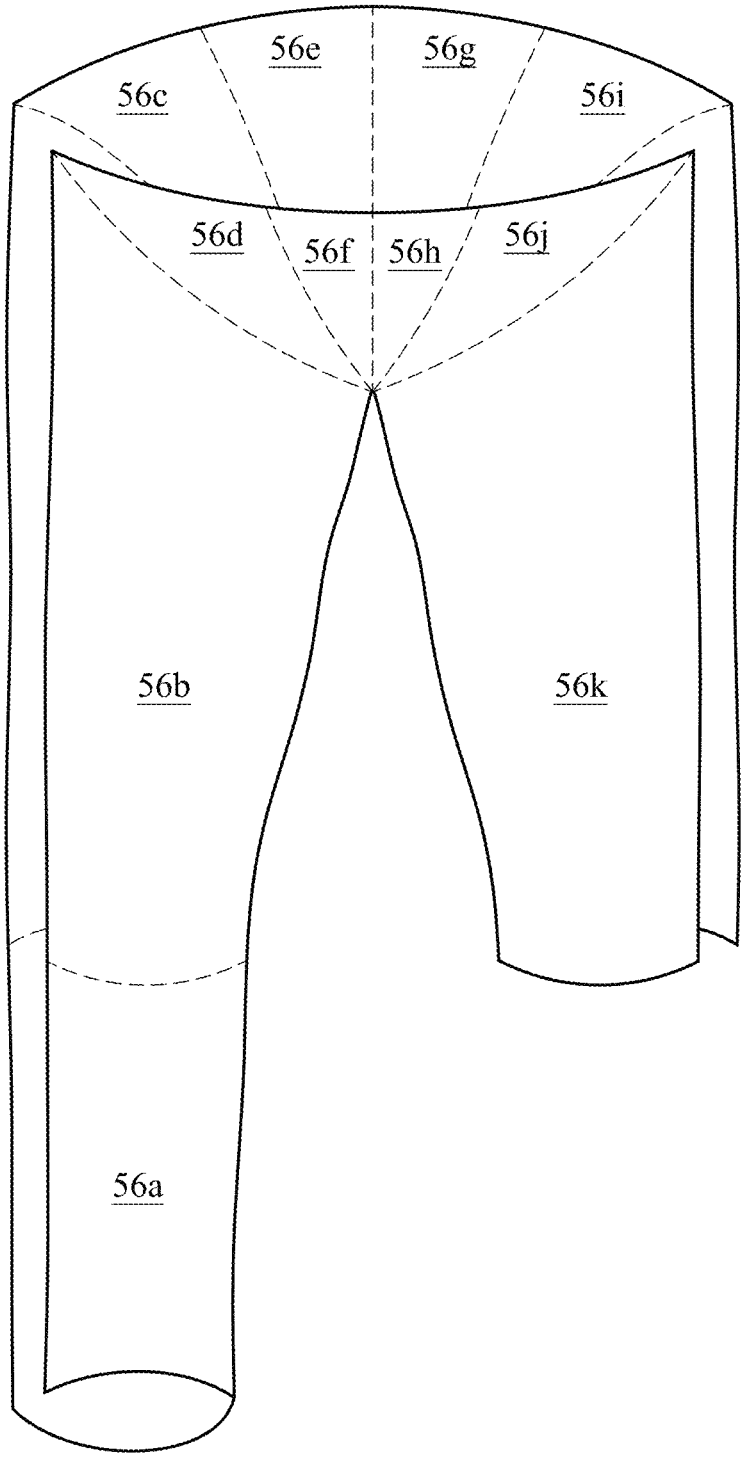

Next, as depicted in FIG. 9G, a wedge-shaped portion 56*k* of the knitted article 10' may be knit by a flatbed knitting machine. Wedge-shaped portion 56*k* may be connected to wedge-shaped portions 56*i* and 56*j* without any seams (i.e., the dashed line does not correspond to any physical structure and is being shown for clarity to indicate the various portions of knitted article 10' that are knit over time). Portion 56*k* may be adapted to cover a knee and thigh of a human body.

Figure 9H:
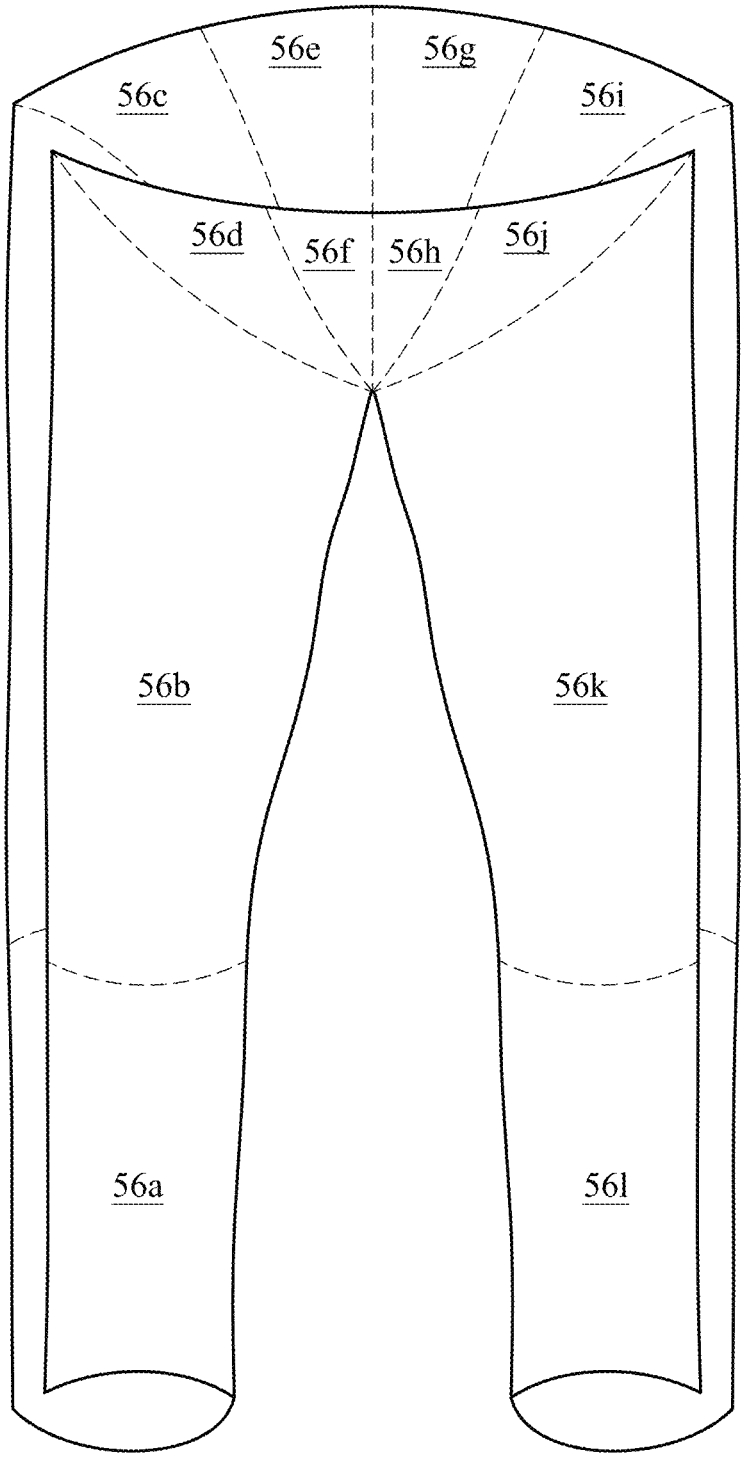

Lastly, as depicted in FIG. 9H, portion 561 of the knitted article 10' may be knit by a flatbed knitting machine. Portion 561 may be roughly rectangular in shape, although it is shown in a curled manner in FIG. 9H. Portion 561 may be adapted to cover a calf a human body.

Figure 10:
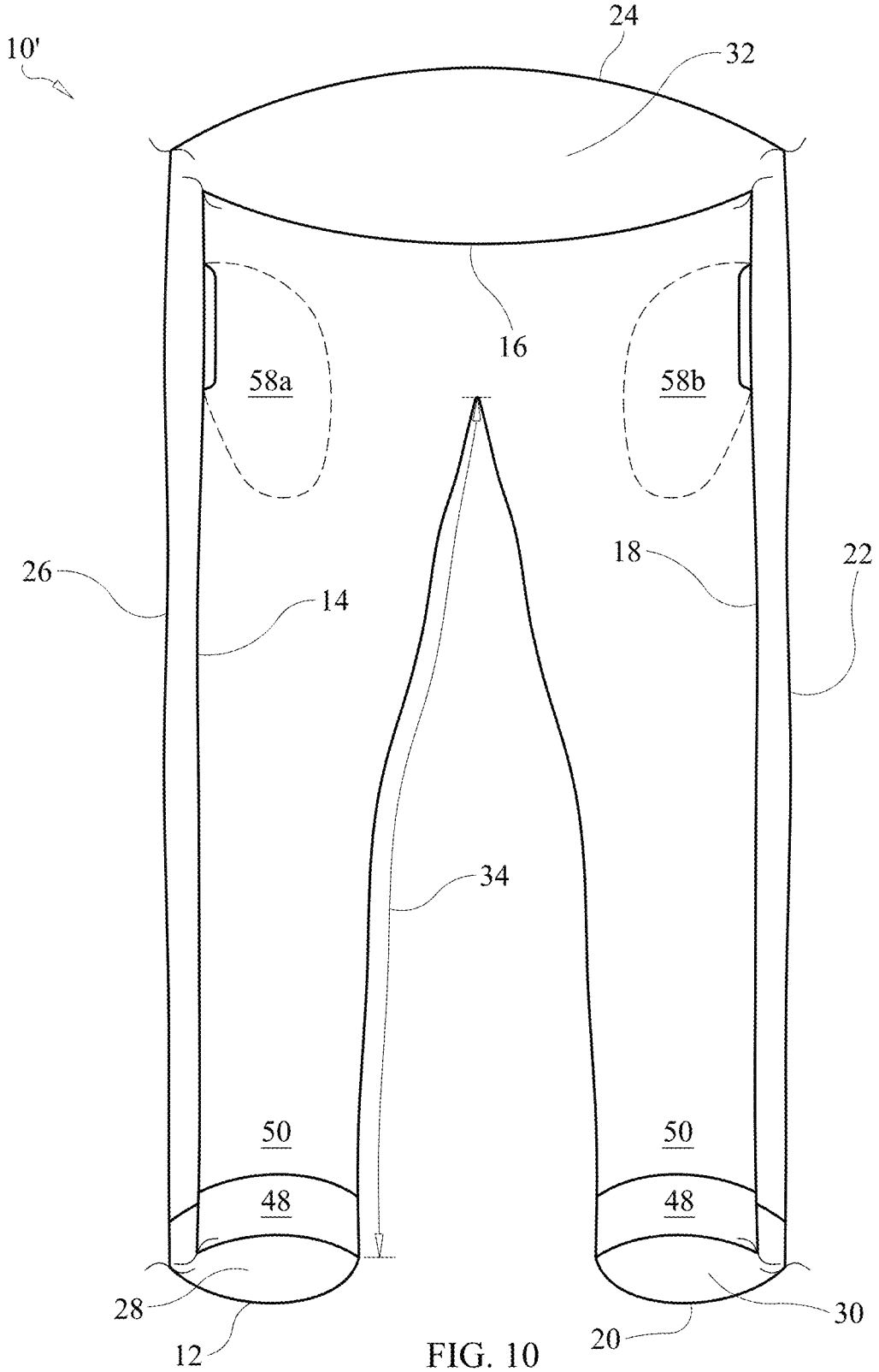
FIG. 10 depicts pockets and an ankle band portion of the knitted article of FIG. 8, in accordance with one embodiment of the invention.

FIG. 10 depicts one or more pockets 58*a*, 58*b* of knitted article 10'. Pockets 58*a*, 58*b* are depicted in dashed outline as they may not be visible from the front view of knitted article 10', and may be disposed behind a front layer of knitted article 10.' It is noted that one or more pockets (in a similar manner as pockets 58*a*, 58*b*) may also be present in the above-described knitted article 10. FIG. 10 also depicts an ankle band portions 48 and non-ankle band portion 50 of the knitted article 10'. In one embodiment, an ankle band portion 48 may have a first material property, and non-ankle band portion 50 may have a second material property different than the first material property. For example, ankle band portion 48 may be ribbed-knit in order to increase the tension of the portion of knitted article 10' around the ankle of the human body, in order to prevent the end portions of knitted article 10' from riding up on the calf of the human body. It is understood that the features of pockets 58*a*, 58*b* and ankle band portions 48 were discussed in a single figure for the sake of conciseness, but these features may not necessarily occur in combination with one another. In another embodiment (not depicted), it is possible for knitted article 10' to include one or more pockets 58*a*, 58*b* without ankle band portions 48. In yet another embodiment (not depicted), it is possible for knitted article 10' to include ankle band portions 48 without one or more pockets 58*a*, 58*b*.

Figure 11:
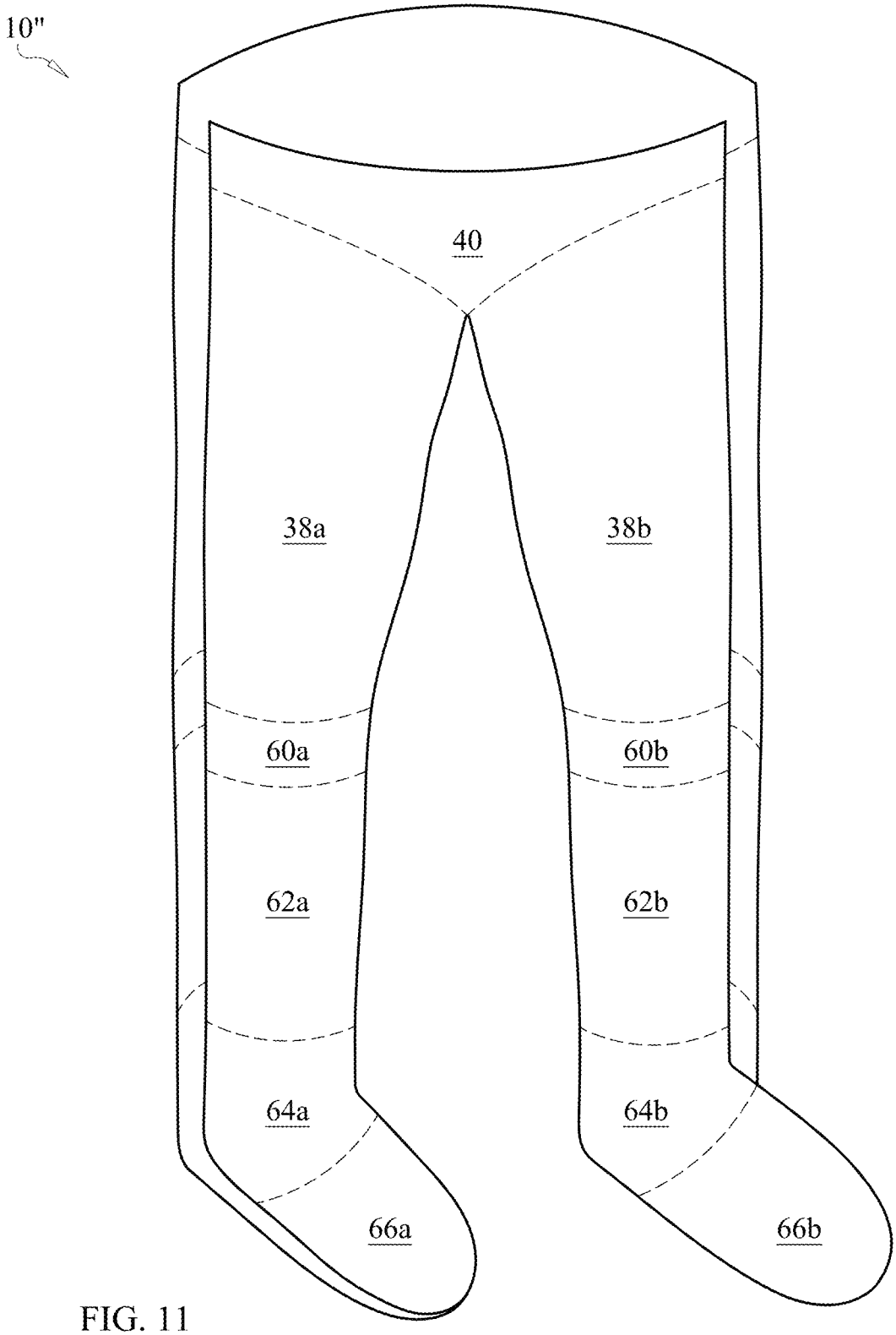
FIG. 11 depicts a knitted article in the form of footed leggings, in accordance with one embodiment of the invention.

FIG. 11 depicts knitted article 10" in the form of footed leggings. For completeness, it is noted that knitted article 10" may include portion 40 for covering a groin area of the human body, portions 38*a*, 38*b* for covering the thighs of the human body, portions 60*a*, 60*b* for covering the knees of the human body, portions 62*a*, 62*b* for covering the calves of the human body, portions 64*a*, 64*b* for covering the ankles of the human body and portions 66*a*, 66*b* for covering the feet of the human body. While knitted article 10" is depicted with all of the above-described portions, it is understood that other knitted articles may include a fewer number of these portions. For instance, knitted article 10 may only include portions 38*a*, 38*b* and 40, and knitted article 10' may only include portions 62*a*, 62*b*, 60*a*, 60*b*, 38*a*, 38*b* and 40. A knitted article (not depicted) may only include portions 60*a*, 60*b*, 38*a*, 38*b* and 40. A knitted article (not depicted) may only include portions 64*a*, 64*b*, 62*a*, 62*b*, 60*a*, 60*b*, 38*a*, 38*b* and 40.

It is noted that knitted article 10' and 10" have been depicted prior to the step of affixing edge 14 to edge 26, and edge 18 to edge 22. For the sake of conciseness, there is no figure that shows the knitted article 10' and 10" after such affixing step, but the reader should be able to understand the state of the knitted article 10' and 10" after such affixing step based on the knitted article 10 in FIG. 7 that is shown after the affixing step.

Figure 12:
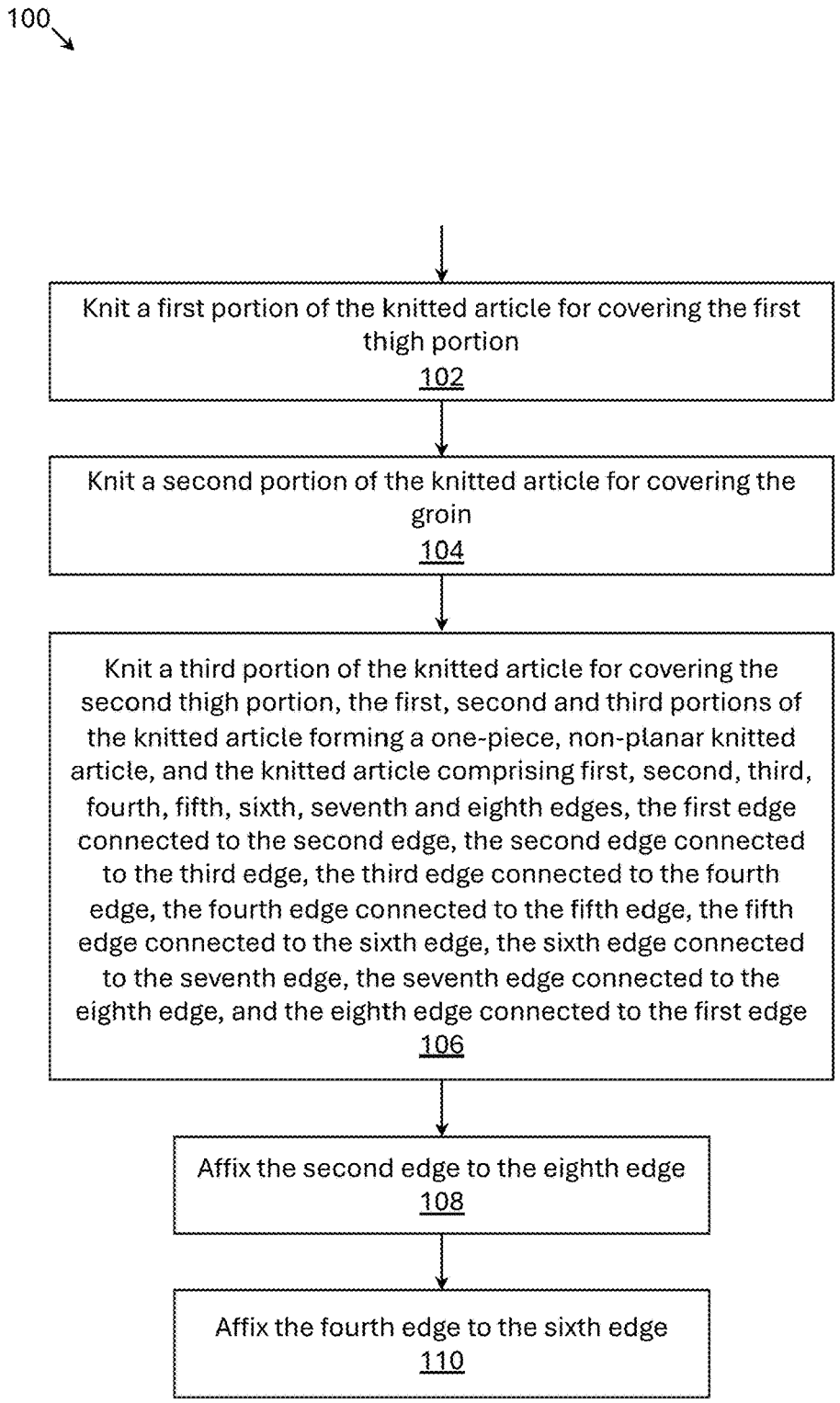
FIG. 12 depicts a flowchart of a process for knitting the knitted article, in accordance with one embodiment of the invention.

FIG. 12 depicts a flowchart 100 of a process for knitting the knitted article 10, or a portion of knitted article 10', 10". In step 102, a flatbed knitting machine may knit portion 38*a* of the knitted article 10, 10', 10" for covering a first thigh portion of the human body. Such step was described above, for example, in FIG. 9B. In step 104 (following step 102), the flatbed knitting machine may knit portion 40 of the knitted article 10, 10', 10" for covering the groin of the human body. Such step was described above, for example, in FIGS. 9C-9F. In step 106 (following step 104), the flatbed knitting machine may knit portion 38*b* of the knitted article 10, 10', 10" for covering a second thigh portion of the human body. Such step was described above, for example, in FIG. 9G. In step 108, edge 14 may be affixed to edge 26 to form seam 54*a*. In step 110, edge 18 may be affixed to edge 22 to form seam 54*b*. Steps 108 and 110 were described above in FIG. 7. It is noted that the order of steps 108 and 110 is not important. Step 108 may occur before step 110, step 110 may occur before step 108, or steps 108 and 110 may occur at the same time.

FIG. 13A depicts a front view of a model 79 of the knitted article 10', with lines indicating the orientation of courses and wales. More specifically, lines 68*a*, 68*b* and 68*c* indicate the orientation of courses of the knitted article 10' and lines 70*a*, 70*b* and 70*c* indicate the orientation of wales of the knitted article 10'. FIG. 13B depicts dashed lines 72*a*, 72*b* indicating a knitting direction on the model 79 of the knitted article 10'. FIG. 13C depicts seam 73 indicated on a side view of the model 79 of the knitted article 10'.

Figure 14B:
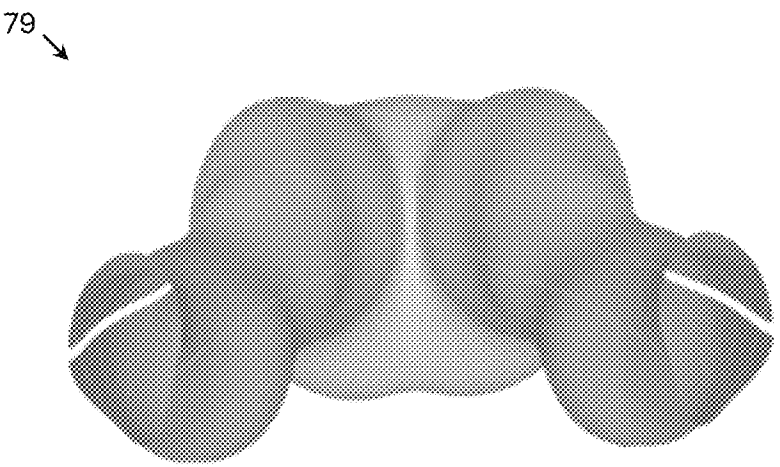
FIG. 14B depicts a bottom view of a model of the knitted article, in accordance with one embodiment of the invention.
Figure 14A:
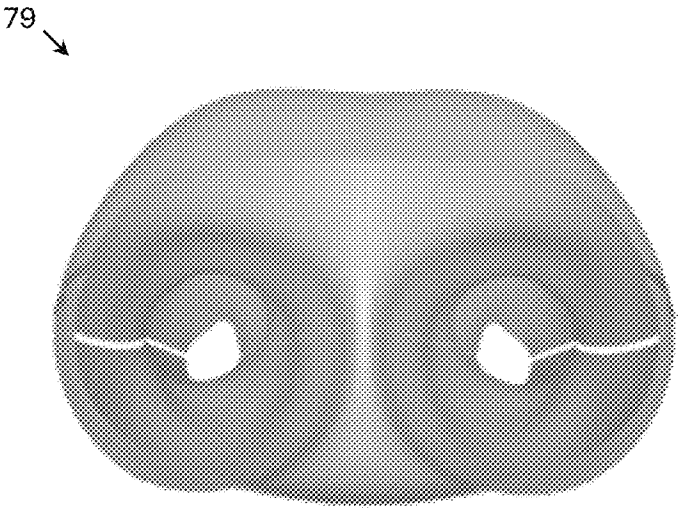
FIG. 14A depicts a top view of a model of the knitted article, in accordance with one embodiment of the invention.

FIG. 14A depicts a top view of a model 79 of the knitted article 10', looking down through opening 32 of the knitted article 10'. FIG. 14B depicts a bottom view of a model 79 of the knitted article 10', showing portions of the knitted article 10' that branch off from a portion of the knitted article which would cover the groin of the human body. In both FIGS. 14A and 14B, the model 79 of the knitted article 10' is depicted in an "unworn" state, without the human body or mannequin to give the knitted article 10' additional structure.

Figure 15:
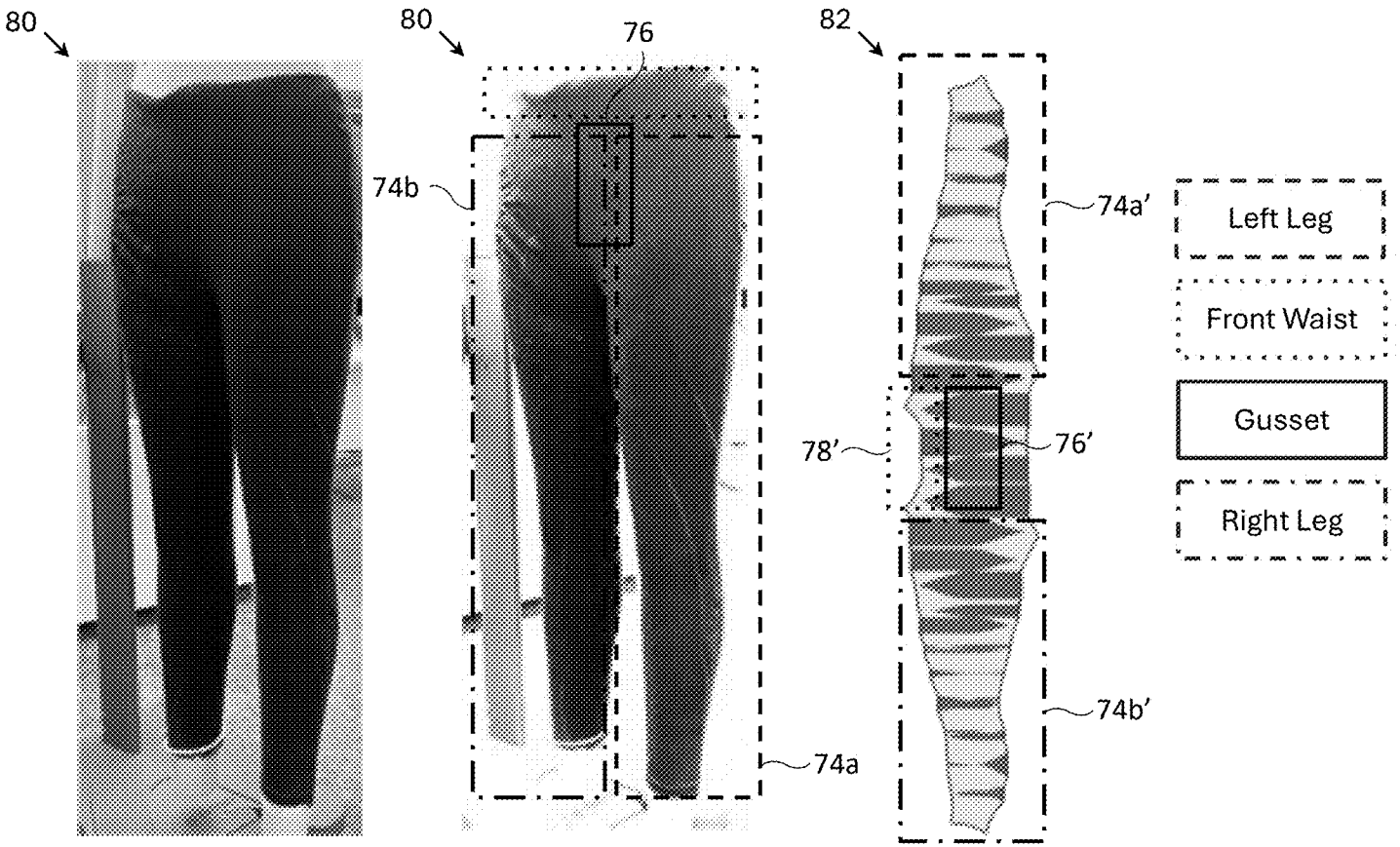
FIG. 15 depicts a photograph of a knitted article (e.g., knitted leggings) and the two-dimensional (2D) knitting map that was used to produce the knitted article, along with annotations showing the correspondence between various regions of the knitted article and the 2D knitting map, in accordance with one embodiment of the invention.

FIG. 15 depicts a photograph 80 of a knitted article 10' (e.g., knitted leggings) and the two-dimensional (2D) knitting map 82 that was used to produce the knitted article 10'. More precisely, the 2D knitting map 82 was used to generate knitting instructions for controlling a flatbed knitting machine to knit the knitted article 10'. Portion 74*a* of the knitted article 10' for covering a left leg of the human body, and a corresponding portion 74*a'* of the 2D knitting map 82 used to knit portion 74*a* are indicated in FIG. 15. Portion 74*b* of the knitted article 10' for covering a right leg of the human body, and a corresponding portion 74*b'* of the 2D knitting map 82 used to knit portion 74*b* have been indicated in FIG. 15. Gusset 76 of the knitted article 10' and a corresponding portion 76' of the 2D knitting map 82 used to knit gusset 76 have been indicated in FIG. 15. Portion 78 of the knitted article 10' for covering a front waist of the human body, and a corresponding portion 78' of the 2D knitting map 82 used to knit portion 78 have been indicated in FIG. 15.

Figure 16:
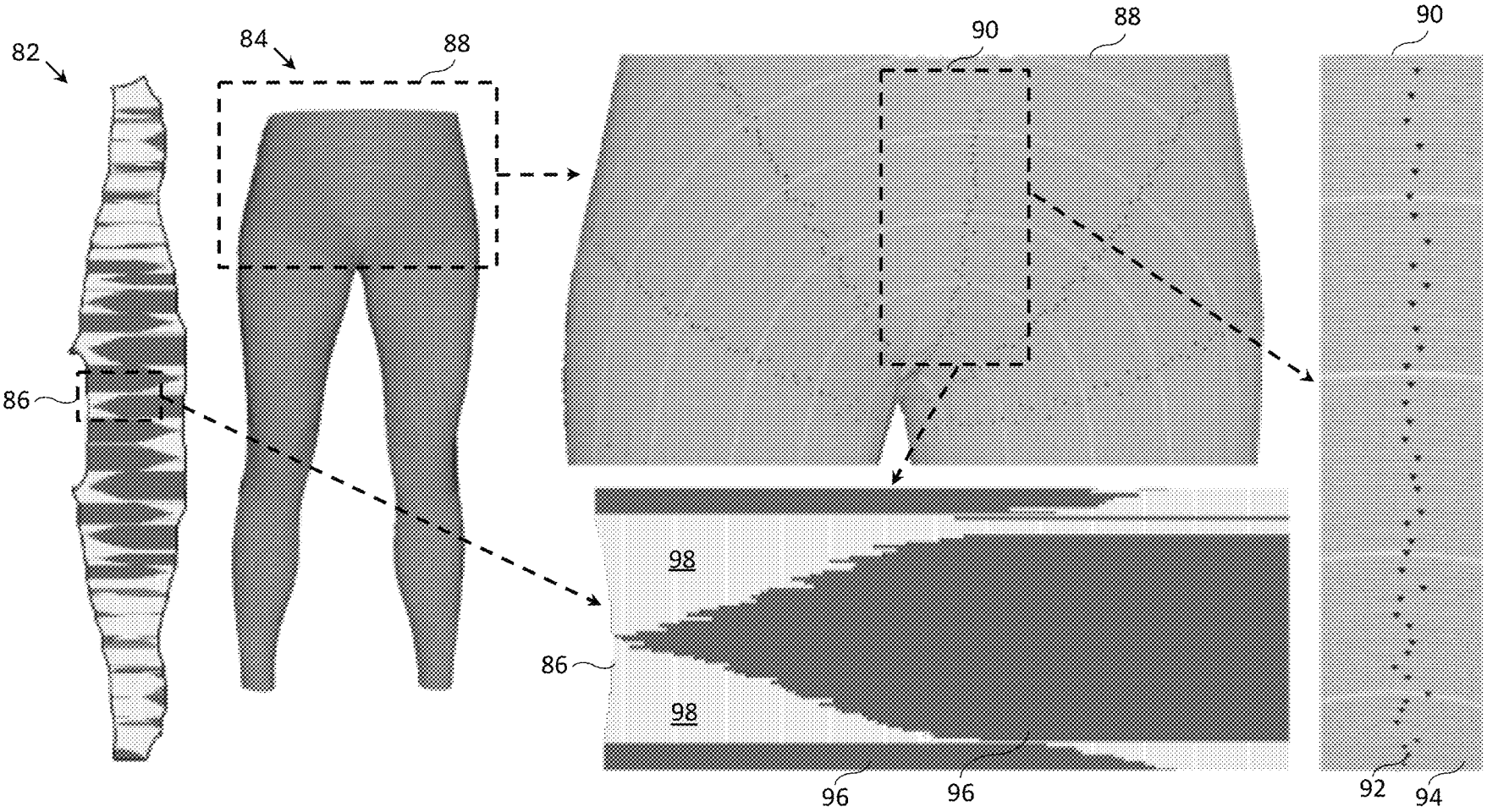
FIG. 16 depicts the 2D knitting map of FIG. 15 and its corresponding 3D knit mesh, along with zoomed-in portions of the former and latter and annotations showing the correspondence between various regions of the 2D knitting map and 3D knit mesh, in accordance with one embodiment of the invention.

FIG. 16 depicts the 2D knitting map 82 of FIG. 15 along with its corresponding 3D knit mesh 84. A zoomed-in portion 88 and a further zoomed-in portion 90 of the 3D knit mesh 84 are depicted in FIG. 16. Polygons 94 (representing one or more stitches) and specific ones of the polygons 94 in a triangular shape, called apexes 92, are more easily visible in zoomed-in portion 90. As is known in the art, apexes may terminate respective ends of a group of courses. A zoomed-in portion 86 of the 2D knitting map 82 is depicted in FIG. 16. Goring regions 96 and knitting regions 98 are more easily visible in zoomed-in portion 86. Rows of knitting regions 98 represent courses of the knitted article 10'. Zoomed-in portion 86 of the 2D knitting map 82 may correspond to zoomed-in portion 90 of the 3D mesh 84. Additional details regarding the meaning of 2D knitting map 82, 3D knit mesh 84, apexes 92, polygons 94, goring regions 96 and knitting regions 98 may be found in US 2023/0357968 to Samosir et al. incorporated herein by reference.

Figure 17D:
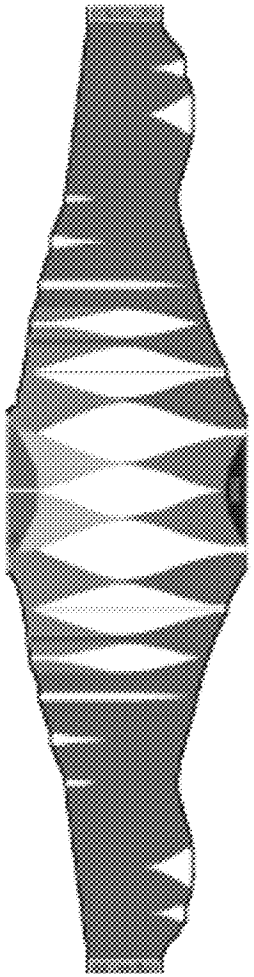
FIG. 17D depicts a 2D knitting map that was used to produce the knitted article of FIGS. 17A-17C, in accordance with one embodiment of the invention.
Figure 17C:
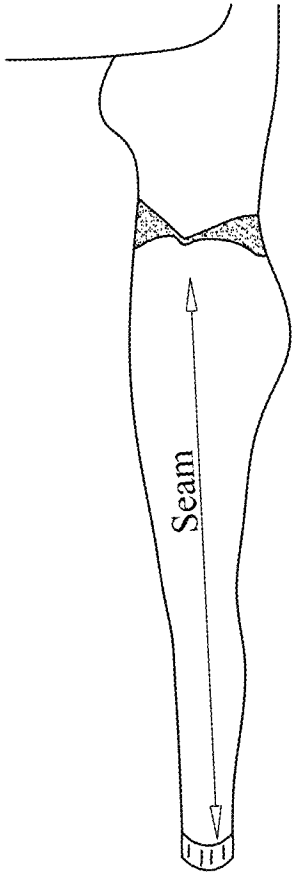
FIG. 17C depicts a photograph of a side view of a knitted article of FIG. 17A, in accordance with one embodiment of the invention.
Figure 17B:
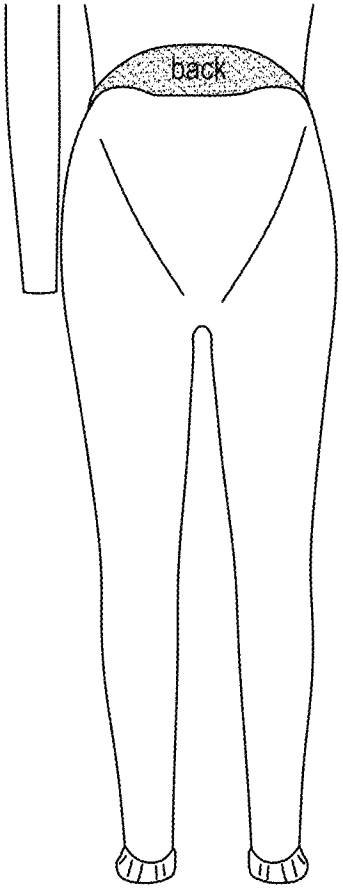
FIG. 17B depicts a photograph of a back view of the knitted article of FIG. 17A, in accordance with one embodiment of the invention.
Figure 17A:
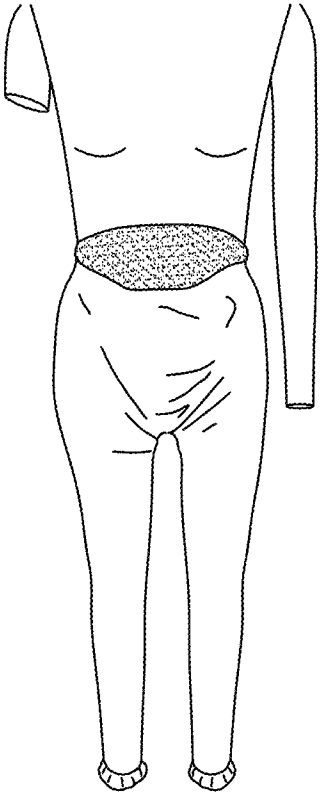
FIG. 17A depicts a photograph of a front view of a knitted article (e.g., knitted leggings), in accordance with one embodiment of the invention.

FIG. 17A depicts a photograph of a front view of a knitted article 10' (e.g., knitted leggings). FIG. 17B depicts a photograph of a back view of the knitted article 10' of FIG. 17A. FIG. 17C depicts a photograph of a side view of a knitted article 10' of FIG. 17A. The location of one of the seams is indicated in the side view of FIG. 17C. FIG. 17D depicts a 2D knitting map that was used to produce the knitted article 10' of FIGS. 17A-17C. More precisely, the 2D knitting map of FIG. 17D was used to generate knitting instructions for controlling a flatbed knitting machine to knit the knitted article 10' of FIGS. 17A-17C. The knitted article 10' depicted in FIGS. 17A-17C includes waist band 36 that was described above in connection with FIG. 3, and also ankle band 48 that was described above in connection with FIG. 10, Further, if one looks closely, the wedge-shaped portions 56*a*-56*c* described above in connection with FIGS. 9C-9E are also visible the knitted article 10' shown in FIGS. 17A-17C.

Figure 18D:
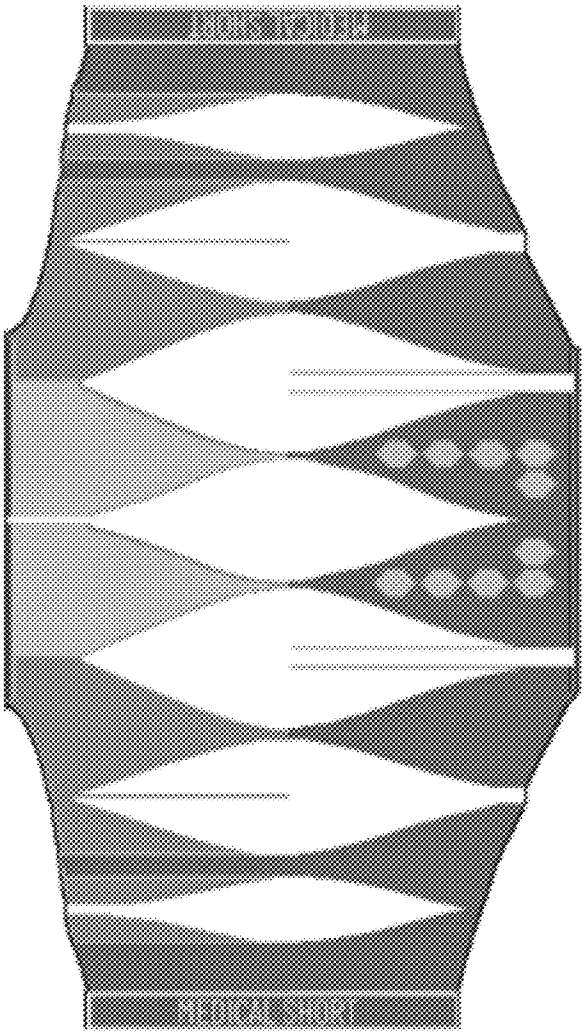
FIG. 18D depicts a 2D knitting map that was used to produce the knitted article of FIGS. 18A-18C, in accordance with one embodiment of the invention.
Figure 18B:
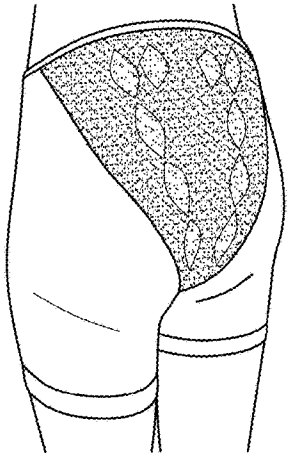
FIG. 18B depicts a photograph of a back view of the knitted article of FIG. 18A, in accordance with one embodiment of the invention.
Figure 18C:
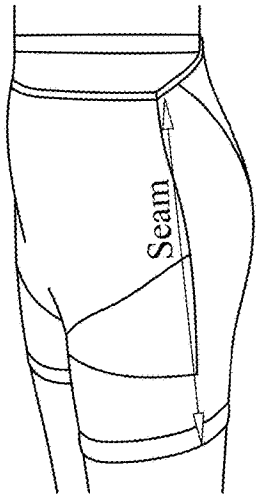
FIG. 18C depicts a photograph of a side view of the knitted article of FIG. 18A, in accordance with one embodiment of the invention.
Figure 18A:
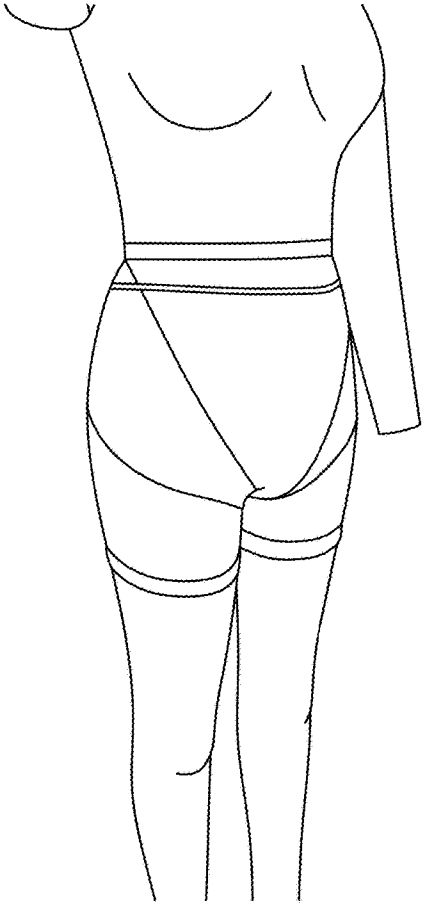
FIG. 18A depicts a photograph of a front view of a knitted article (e.g., knitted medical shorts), in accordance with one embodiment of the invention.

FIG. 18A depicts a photograph of a front view of a knitted article 10 (e.g., knitted medical shorts). FIG. 18B depicts a photograph of a back view of the knitted article 10 of FIG. 18A. FIG. 18C depicts a photograph of a side view of the knitted article 10 of FIG. 18A. The location of one of the seams is indicated in the side view of FIG. 18C. FIG. 18D depicts a 2D knitting map that was used to produce the knitted article 10 of FIGS. 18A-18C. More precisely, the 2D knitting map of FIG. 18D was used to generate knitting instructions for controlling a flatbed knitting machine to knit the knitted article 10 of FIGS. 18A-18C. Likewise, if one looks closely, the wedge-shaped portions 56*a*-56*c* described above in connection with FIGS. 9C-9E are also visible the knitted article 10 shown in FIGS. 18A-18C.

Figure 19C:
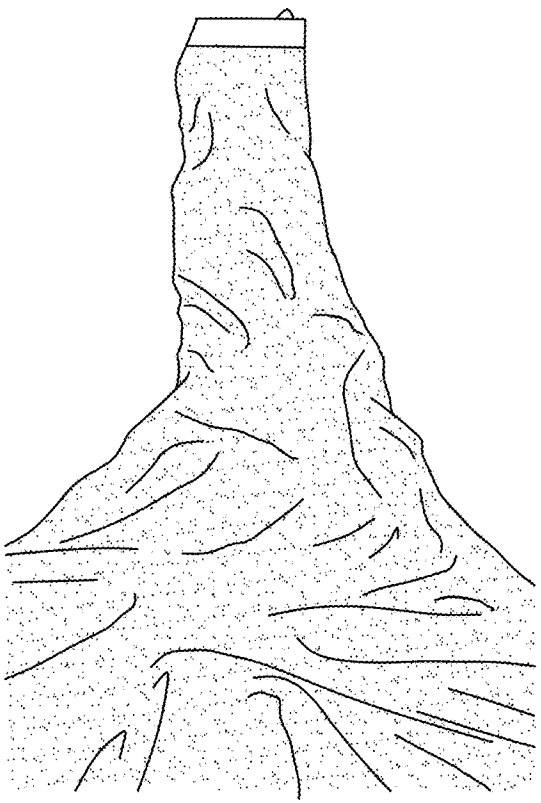
FIG. 19C depicts a photograph of a close up portion of a portion of the knitted article of FIG. 19A for covering a leg of the human body, in accordance with one embodiment of the invention.
Figure 19B:
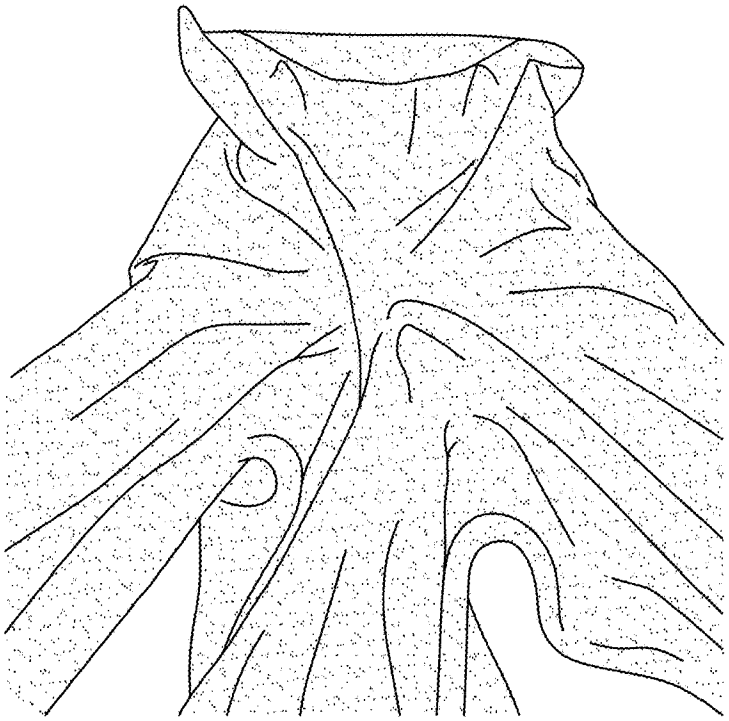
FIG. 19B depicts a photograph of a bottom view of a portion of the knitted article of FIG. 19A for covering a groin of a human body, in accordance with one embodiment of the invention.
Figure 19A:
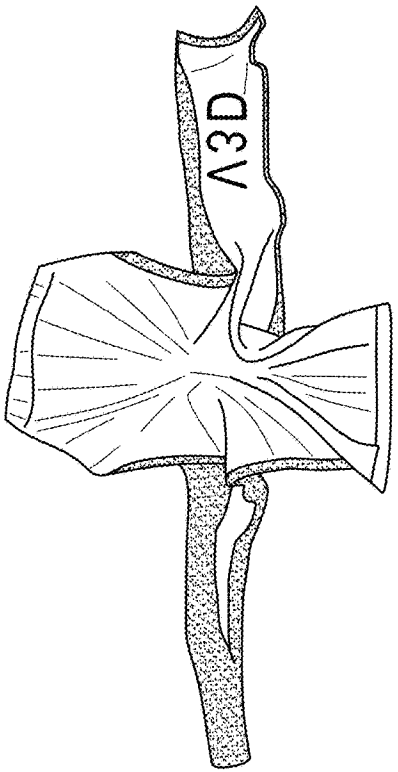
FIG. 19A depicts a photograph of a top view of a knitted article (e.g., knitted leggings) prior to any edges being affixed to one another to form seams, in accordance with one embodiment of the invention.

FIG. 19A depicts a photograph of a top view of a knitted article 10' (e.g., knitted leggings) prior to any edges being affixed to one another to form seams. FIG. 19B depicts a photograph of a bottom view of a portion of the knitted article 10' of FIG. 19A for covering a groin of a human body. FIG. 19C depicts a photograph of a close up of a portion of the knitted article 10' of FIG. 19A for covering a leg of the human body.

As should be apparent in the discussion of embodiments of the invention, various operations referred to herein are machine operations, Useful machines for performing the operations of the present invention include both the target fabrication machines which will produce the desired articles being constructed, and digital computer systems or other similar devices. The present invention involves, to some degree, the production of instructions for operating, that is controlling the operation of, the target fabrication machines to produce a desired result. Those instructions by which the target fabrication machine will produce the desired result are created, in part, using one or more programmed digital computer systems, which in some cases may intercommunicate with one another. For example, in one embodiment of the invention, a first computer system, referred to as a "client" is used to construct and/or customize a 3D model of the article to be fabricated, and that model is then passed to a second computer system, referred to as a "server" or "host," where the 3D model is converted to a 2D knitting map or other representation suitable for translation into instructions for the target fabrication machine. In other cases, a single digital computer system may be used for both aspects of the operation, for example in a service-as-a-platform based approach in which a client computer system is used merely as a visualization and human-interaction instrument to observe, direct, and control processes executing on a server.

Figure 20:
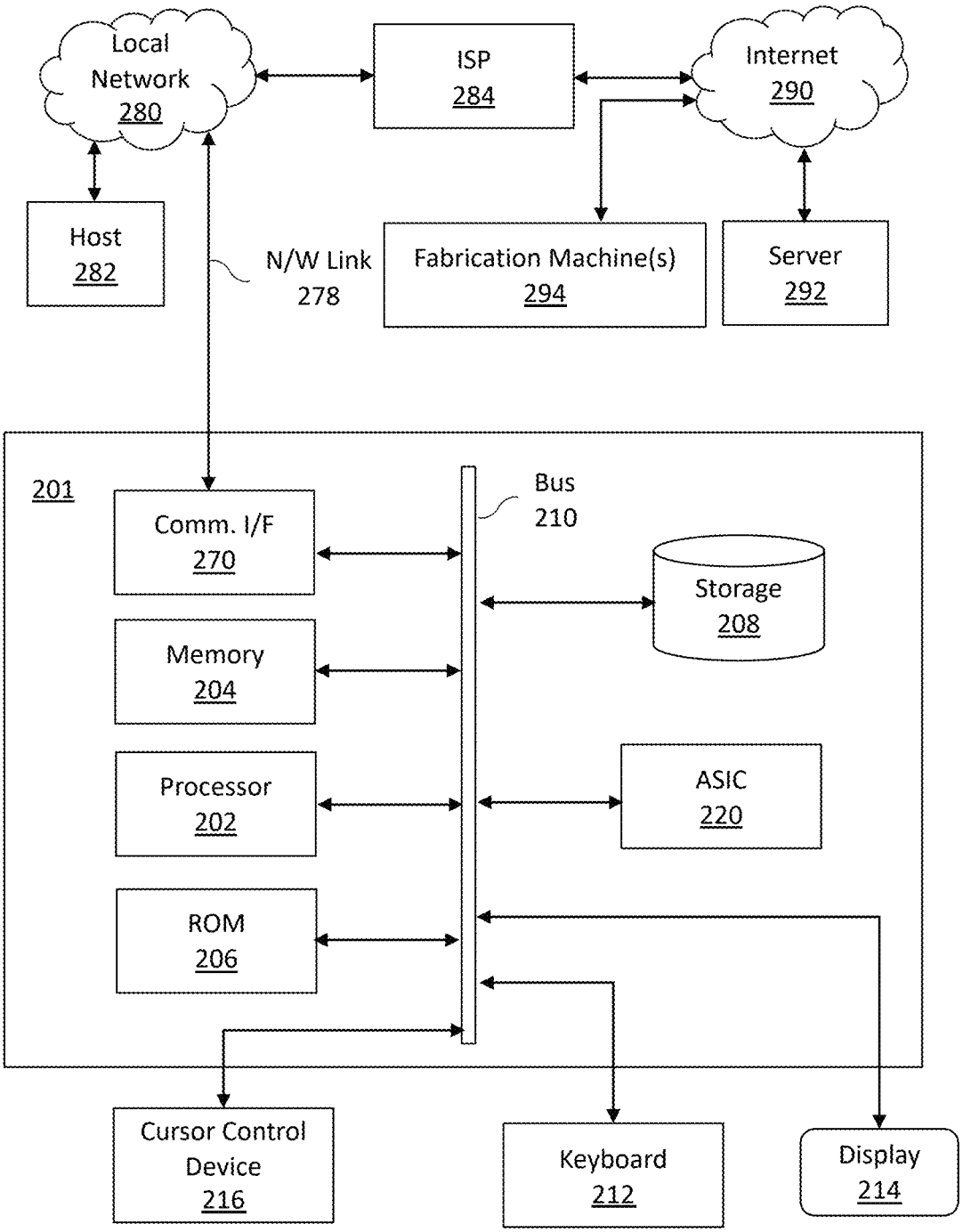
FIG. 20 illustrates an example of a networked computer system for executing computer-executable instructions for generating knitting instructions for controlling computer-controlled machines, including flatbed knitting machines, sewing machines and welding machines, in accordance with one embodiment of the invention.

FIG. 20 illustrates an example of the architecture described immediately above. In this arrangement, a computer system 201 is programmed via stored processor-executable instructions to interact with a server 292 in the production of instructions for operating, that is controlling the operation of, the target fabrication machine(s) 294 (e.g., flatbed knitting machine, sewing machine, welding machine, etc.) to produce a desired result in accordance with the present invention. In one embodiment, computer system 201 acts as a client to server 292 and is programmed to allow a user to construct and/or customize a 3D model of the article to be fabricated, which model is then passed to server 292 where the 3D model is converted to a 2D knitting map, 3D knit mesh or other representation suitable for translation into instructions for the target fabrication machine. In another embodiment, server 292 is used by computer system 201 for both aspects of the operation (e.g., as a service-as-a-platform), and allows a user to interact with programs running on server 292 via a web browser or other client application. In the foregoing description, when an operation is described as being performed by an application running on a computer system, it should be understood that particular processor-executable instructions which make up such an application, when executed by one or more processors, such as processor(s) 202 of computer system 201 or similar processor(s) of the server, cause those processors to perform the described operations, in some cases by invoking other elements of the computer system to operate in accordance with the functions specified by the instructions.

As illustrated, computer system 201 generally includes a communication mechanism such as a bus 210 for passing information (e.g. data and/or instructions) between various components of the system, including one or more processors 202 for processing the data and instructions. Processor(s) 202 perform(s) operations on data as specified by the stored computer programs on computer system 201, such as the stored computer programs for running a web browser and/or for constructing and/or customizing a 3D model of the article to be fabricated that make up the application described herein and/or visualizing results of server-based operations of such an application. The stored computer programs for computer system 201 and server 292 may be written in any convenient computer programming language and then compiled into a native instructions for the processors resident on the respective machines, Computer system 201 also includes a memory 204, such as a random access memory (RAM) or any other dynamic storage device, coupled to bus 210. Memory 204 stores information, including processor-executable instructions, data, and temporary results, for performing the operations described herein, Computer system 201 also includes a read only memory (ROM) 206 or any other static storage device coupled to the bus 210 for storing static information, including processor-executable instructions, that is not changed by the computer system 201 during its operation. Also coupled to bus 210 is a non-volatile (persistent) storage device 208, such as a magnetic disk, optical disk, solid-state disc, or similar device for storing information, including processor-executable instructions, that persists even when the computer system 201 is turned off. Memory 204, ROM 206, and storage device 208 are examples of a non-transitory "computer-readable medium."

Computer system 201 may also include human interface elements, such as a keyboard 212, display 214, and cursor control device (e.g., a mouse or trackpad) 216, each of which is coupled to bus 210. These elements allow a human user to interact with and control the operation of computer system 201. For example, these human interface elements may be used for controlling a position of a cursor on the display 214 and issuing commands associated with graphical elements presented thereon. In the illustrated example of computer system 201, special purpose hardware, such as an application specific integrated circuit (ASIC) 220, is coupled to bus 210 and may be configured to perform operations not performed by processor 202; for example, ASIC 220 may be a graphics accelerator unit for generating images for display 214.

To facilitate communication with external devices, computer system 201 also includes a communications interface 270 coupled to bus 210. Communication interface 270 provides bi-directional communication with remote computer systems such as server 292 and host 282 over a wired or wireless network link 278 that is communicably connected to a local network 280 and ultimately, through Internet service provider 284, to Internet 290. Server 292 is connected to Internet 290 and hosts a process that provides a service in response to information received over the Internet. For example, server 292 may host some or all of a process that provides a user the ability to construct and/or customize a 3D model of an article to be fabricated, which 3D model is then converted to a 2D knitting map, 3D knit mesh or other representation suitable for translation into instructions for the target fabrication machine, in accordance with embodiments of the present invention. It is contemplated that components of an overall system can be deployed in various configurations within one or more computer systems (e.g., computer system 201, host 282 and/or server 292).

Thus, a one-piece knitted article for the lower portion of the human body and methods for knitting same have been described.

LIST OF REFERENCE NUMERALS

10, 10', 10" Knitted article
12, 14, 16, 18, 20, 24, 26 Edge of knitted article
28, 30, 32 Opening
34 In-seam of knitted article
36 Waistband portion
37 Non-waistband portion
38*a*, 38*b* Portion of knitted article for covering thigh portion
Portion of knitted article for covering groin
44 Gusset
46 Pocket or spacer fabric
48 Ankle band portion
50 Non-ankle band portion
52*a*, 52*b* Strip of material
54*a*, 54*b* Seam
56*a*, 56*b*, 56*c*, 56*d*, 56*e*, 56*f*, 56*g*, 56*h*, 56*i*, 56*j*, 56*k*, 561 Knitted portions
58*a*, 58*b* Pockets
60*a*, 60*b* Portion of knitted article for covering knee
62*a*, 62*b* Portion of knitted article for covering calf
64*a*, 64*b* Portion of knitted article for covering ankle
66*a*, 66*b* Portion of knitted article for covering foot
68*a*, 68*b*, 68*c* Orientation of course
70*a*, 70*b*, 70*c* Orientation of wale
72*a*, 72*b* Knitting direction
73 Seam
74*a* Portion of knitted article for covering left leg
74*a*' Corresponding portion of 2D knitting map
74*b* Portion of knitted article for covering right leg
74*b*' Corresponding portion of 2D knitting map
76 Portion of knitted article for covering gusset
76' Corresponding portion of 2D knitting map
78 Portion of knitted article for covering front waist
78' Corresponding portion of 2D knitting map
79 Model of knitted article
80 Photograph of knitted article
82 2D knitting map used to knit knitted article
84 3D knit mesh
86 Zoomed-in portion of 2D knitting map
88 Zoomed-in portion of 3D knit mesh
90 Further zoomed-in portion of 3D knit mesh
92 Apex
94 Polygon
96 Goring region
98 Knitting region
100 Flow diagram
102, 104, 106, 108, 110 Step
201 Computer system
202 Processor
204 Memory
206 ROM
208 Storage
210 Bus
212 Keyboard
214 Display
216 Cursor control device
270 Communication interface
278 Wired or wireless network link
280 Local network
282 Host
284 Internet service provider
290 Internet
292 Server
294 Fabrication Machine(s)

What is claimed is:

1. A method for generating a knitted article having a first, second and third opening, the knitted article adapted to cover at least a groin, a first thigh portion and a second thigh portion of a human body, the method comprising:

knitting via a flatbed knitting machine a first portion of the knitted article for covering the first thigh portion;

after knitting the first portion, knitting via the flatbed knitting machine a second portion of the knitted article for covering the groin;

after knitting the second portion, knitting via the flatbed knitting machine a third portion of the knitted article for covering the second thigh portion, wherein the first, second and third portions of the knitted article form a one-piece, non-planar knitted article, and wherein the knitted article comprises first, second, third, fourth, fifth, sixth, seventh and eighth edges, the first edge connected to the second edge, the second edge connected to the third edge, the third edge connected to the fourth edge, the fourth edge connected to the fifth edge, the fifth edge connected to the sixth edge, the sixth edge connected to the seventh edge, the seventh edge connected to the eighth edge, and the eighth edge connected to the first edge; and affixing the second edge to the eighth edge and affixing the fourth edge to the sixth edge, wherein the first edge forms the first opening of the knitted article, wherein the third and seventh edges form the second opening of the knitted article, wherein the fifth edge forms the third opening of the knitted article, and wherein the knitted article does not include a front rise seam or a back rise seam.

2. The method of claim 1, wherein the second portion of the knitted article comprises a waistband portion with a first material property, and a non-waistband portion with a second material property different than the first material property.

3. The method of claim 1, wherein the second portion of the knitted article comprises a gusset, and wherein the gusset is formed from a material that is more opaque than other portions of the knitted article.

4. The method of claim 1, wherein the second portion of the knitted article comprises a gusset, and wherein the gusset comprises one or more of a pocket or spacer fabric.

5. The method of claim 1, wherein the knitted article comprises an ankle band portion with a first material property, and a non-ankle band portion with a second material property different than the first material property.

6. The method of claim 1, wherein the knitted article forms shapewear.

7. The method of claim 1, wherein affixing the second edge to the eighth edge comprises sewing the second edge to the eighth edge, and affixing the fourth edge to the sixth edge comprises sewing the fourth edge to the sixth edge.

8. The method of claim 1, wherein affixing the second edge to the eighth edge comprises using a first zipper to affix the second edge to the eighth edge, and affixing the fourth edge to the sixth edge comprises using a zipper means to affix the fourth edge to the sixth edge.

9. The method of claim 1, wherein affixing the second edge to the eighth edge comprises using a first hook and loop fastener to affix the second edge to the eighth edge, and affixing the fourth edge to the sixth edge comprises using a second hook and loop fastener to affix the fourth edge to the sixth edge.

10. The method of claim 1, wherein affixing the second edge to the eighth edge comprises linking the second edge to the eighth edge, and affixing the fourth edge to the sixth edge comprises linking the fourth edge to the sixth edge.

11. The method of claim 1, wherein affixing the second edge to the eighth edge comprises welding the second edge to the eighth edge, and affixing the fourth edge to the sixth edge comprises welding the fourth edge to the sixth edge.

12. The method of claim 1, wherein affixing the second edge to the eighth edge comprises affixing the second and eighth edges to a first strip of material distinct from the knitted article, and affixing the fourth edge to the sixth edge comprises affixing the fourth and sixth edges to a second strip of material distinct from the knitted article.

13. The method of claim 1, wherein affixing the second edge to the eighth edge forms a first seam, and affixing the fourth edge to the sixth edge forms a second seam that faces away from the first seam.

14. The method of claim 1, wherein the first and third portions of the knitted article are each defined by a non-zero inseam measurement.

15. The method of claim 1, wherein the knitted article comprises one or more pockets.

16. The method of claim 1, wherein knitting the second portion comprises knitting a plurality of wedged-shaped portions that are joined with one another.

17. The method of claim 1, wherein the knitted article comprises a fourth portion for covering a knee of the human body.

18. The method of claim 17, wherein the knitted article comprises a fifth portion for covering a calf of the human body.

19. The method of claim 18, wherein the knitted article comprises a sixth portion for covering an ankle of the human body.

20. The method of claim 19, wherein the knitted article comprises a seventh portion for covering a foot of the human body.

21. The method of claim 1, wherein the knitted article is one of leggings, pants, an undergarment, a swim wear or a medical compression wearable article.

22. A knitted article formed by performing the method of claim 1.

23. A non-transitory computer readable media comprising instructions for generating a knitted article having a first, second and third opening, the knitted article adapted to cover at least a groin, a first thigh portion and a second thigh portion of a human body, the instructions which, when executed by one or more processors, cause the one or more processors to control a flatbed knitting machine to:

knit a first portion of the knitted article for covering the first thigh portion;

after knitting the first portion, knit a second portion of the knitted article for covering the groin; and after knitting the second portion, knit a third portion of the knitted article for covering the second thigh portion, wherein the first, second and third portions of the knitted article form a one-piece, non-planar knitted article, and wherein the knitted article comprises first, second, third, fourth, fifth, sixth, seventh and eighth edges, the first edge connected to the second edge, the second edge connected to the third edge, the third edge connected to the fourth edge, the fourth edge connected to the fifth edge, the fifth edge connected to the sixth edge, the sixth edge connected to the seventh edge, the seventh edge connected to the eighth edge, and the eighth edge connected to the first edge; and cause the one or more processors to control a fabrication machine to affix the second edge to the eighth edge and affix the fourth edge to the sixth edge, wherein the first edge of the knitted article forms the first opening of the knitted article, wherein the third and seventh edges form the second opening of the knitted article, wherein the fifth edge forms the third opening of the knitted article, and wherein the knitted article does not include a front rise seam or a back rise seam.

* * * * *